US007877031B2

(12) United States Patent
Fukushi

(10) Patent No.: US 7,877,031 B2
(45) Date of Patent: Jan. 25, 2011

(54) IMAGE FORMING APPARATUS HAVING TONER DENSITY CONTROL

(75) Inventor: Kenji Fukushi, Kashiwa (JP)

(73) Assignee: Canon Kabushiki Kaisha (JP)

( * ) Notice: Subject to any disclaimer, the term of this patent is extended or adjusted under 35 U.S.C. 154(b) by 220 days.

(21) Appl. No.: 12/277,370

(22) Filed: Nov. 25, 2008

(65) Prior Publication Data

US 2009/0136251 A1 May 28, 2009

(30) Foreign Application Priority Data

Nov. 26, 2007 (JP) ..... 2007-304605

(51) Int. Cl.
*G03G 15/10* (2006.01)

(52) U.S. Cl. ..... 399/64

(58) Field of Classification Search ..... 399/30, 399/62, 64, 74; 118/691
See application file for complete search history.

(56) References Cited

U.S. PATENT DOCUMENTS

| | | | | |
|---|---|---|---|---|
| 4,236,486 | A * | 12/1980 | Nakamine et al. | 399/59 |
| 4,369,733 | A * | 1/1983 | Hirakura et al. | 399/64 |
| 5,067,435 | A * | 11/1991 | Hosaka | 399/64 |
| 6,321,044 | B1 * | 11/2001 | Tanaka | 399/49 |
| 7,020,404 | B2 | 3/2006 | Fukuda et al. | |
| 7,751,735 | B2 * | 7/2010 | Takahashi | 399/49 |
| 7,751,741 | B2 * | 7/2010 | Hirai | 399/74 |
| 2004/0042816 | A1 | 3/2004 | Fukuda et al. | |

FOREIGN PATENT DOCUMENTS

| | | | |
|---|---|---|---|
| EP | 1394624 | A1 | 3/2004 |
| JP | 09243559 | A * | 9/1997 |
| JP | 2004-110018 | A | 4/2004 |
| JP | 2007021799 | A * | 2/2007 |

* cited by examiner

*Primary Examiner*—Robert Beatty
(74) *Attorney, Agent, or Firm*—Rossi, Kimms & McDowell LLP

(57) ABSTRACT

An image forming apparatus capable of setting a criterion individually for respective image forming apparatuses, which is used in determining whether or not a developer is properly supplied to a developing unit, thereby stabilizing a developer toner density. With a shutter member closed, reflection light from a reflection sheet is received by a toner density detection sensor, and an output voltage is stored in a memory. After the shutter member is opened, reflection light from a developing sleeve is received by the sensor, and an output voltage is stored in the memory. If an amount of change in voltage per unit toner density calculated based on the output voltages does not fall within a predetermined range, an operation of a main unit of the image forming apparatus is stopped. If the amount of voltage change falls within the predetermined range, the amount of voltage change is stored in the memory.

2 Claims, 19 Drawing Sheets

IMAGE FORMING APPARATUS HAVING TONER DENSITY CONTROL

BACKGROUND OF THE INVENTION

1. Field of the Invention

The present invention relates to an image forming apparatus for electrophotographic image formation.

2. Description of the Related Art

Conventionally, there has been known an electrophotographic image forming apparatus (e.g., copying machine or printer) for developing a latent image formed on an image carrier (e.g., photosensitive drum) into an image and transferring it onto a recording sheet for image formation. The electrophotographic image forming apparatus includes a developing device in which a latent image is developed using a developer. When a two-component system developer is used for the image development, the developer toner density must be maintained constant to stabilize the resultant image density.

To maintain the developer toner density constant, there has generally been used a method in which the toner density is detected by an optical detection system. As the toner density detection method based on the optical detection system, there are a method based on a developer reflection system and a method based on an image density detection system.

The developer reflection system-based method uses a density detection sensor disposed near a developing sleeve of a developing device on which a two-component system developer with carrier and toner is carried. With the density detection sensor, an amount of reflection light from the developer on the developing sleeve is detected, thereby detecting the developer toner density. On the other hand, the image density detection system-based method forms a reference patch image on an image carrier, and detects an amount of reflection light from the reference patch image to detect the toner density of a developer used for development of the reference patch image.

The image density detection system measures the toner density on the image carrier and controls a toner supply amount within the developing device to make the density of an image actually transferred to a recording sheet constant. However, the amount of reflection light from the reference patch image varies depending also on the manner of bias voltage control for the image carrier and an amount of laser light irradiated onto the image carrier. Therefore, the image density detection system is not often used alone, but often used in combination with a developer reflection system-based density detection sensor for measuring the toner density within the developing device.

Due to a variation (individual difference) in output between developer reflection system-based density detection sensors, there occurs a difference in an amount of reflection light from the developer on the developing sleeve between the sensors, even between those that have the same developer toner density.

To obviate this, there has been proposed a method for reducing a variation in output between density detection sensors (see, for example, Japanese Laid-open Patent Publication No. 2004-110018). This prior art method adjusts an amount of light emission from a density detection sensor so as to make an amount of reflection light from a developer constant in a state that a contamination prevention shutter member is closed, which is disposed to be openable/closable and to face the sensor.

There is another prior art method which controls a density detection sensor such that an amount of light emission therefrom is always made constant. Specifically, at the initial setting of a product (image forming apparatus), reflection light from a developer of predetermined density in a developing device is detected by a density detection sensor, and an output value from the sensor is stored into a memory for use in correcting a variation between sensors.

In the above described prior art techniques, the output of the density detection sensor at a predetermined toner density is controlled to be a constant value. Alternatively, an output value of the density detection sensor at a predetermined toner density is stored in advance, and an output value of the sensor attained when reflection light from a developer currently carried on a developing sleeve is detected is converted into a toner density. However, the output value of the sensor at the predetermined toner density used for the conversion is a mere constant value. In other words, a variation in output without the predetermined toner density between density detection sensors is not taken into consideration.

SUMMARY OF THE INVENTION

The present invention provides an image forming apparatus and a control method therefore capable of setting a criterion individually for respective image forming apparatuses, the criterion being used in determining whether or not a developer is properly supplied to a developing unit, whereby a developer toner density in the developing unit can be stabilized.

According to this invention, there is provided an image forming apparatus comprising an image carrier adapted to be formed with an electrostatic latent image, a developing unit adapted to develop the electrostatic latent image formed on the image carrier using a developer including toner, a detection unit which has a light emitting unit adapted to irradiate light onto the developer in the developing unit and a light receiving unit adapted to receive light reflected by the developer, the detection unit being adapted to output a signal corresponding to a toner density representing a toner ratio in the developer, and a determination unit adapted to determine whether or not a difference between a signal output from the detection unit when the detection unit detects a reference developer having a predetermined density and a signal output from the detection unit when the detection unit detects a reference member having a density different from the predetermined density falls within a predetermined range.

With this invention, whether or not an amount of change in output of the detection unit falls within the predetermined range is determined based on an amount of reflection light from the reference member which is substantially the same as an amount of reflection light from a developer having a predetermined toner density, whereby a variation in detection sensitivity between detection units of image forming apparatuses can be corrected. Therefore, the developer toner density in the developing unit can substantially accurately be determined. As a result, the criterion used in determining whether or not the developer is properly supplied to the developing unit can be set individually for respective image forming apparatuses, whereby the developer toner density in the developing unit can be stabilized.

Further features of the present invention will become apparent from the following description of exemplary embodiments with reference to the attached drawings.

DETAILED DESCRIPTION OF THE PREFERRED EMBODIMENTS

The present invention will now be described in detail below with reference to the drawings showing preferred embodiments thereof.

First Embodiment

Figure 1:
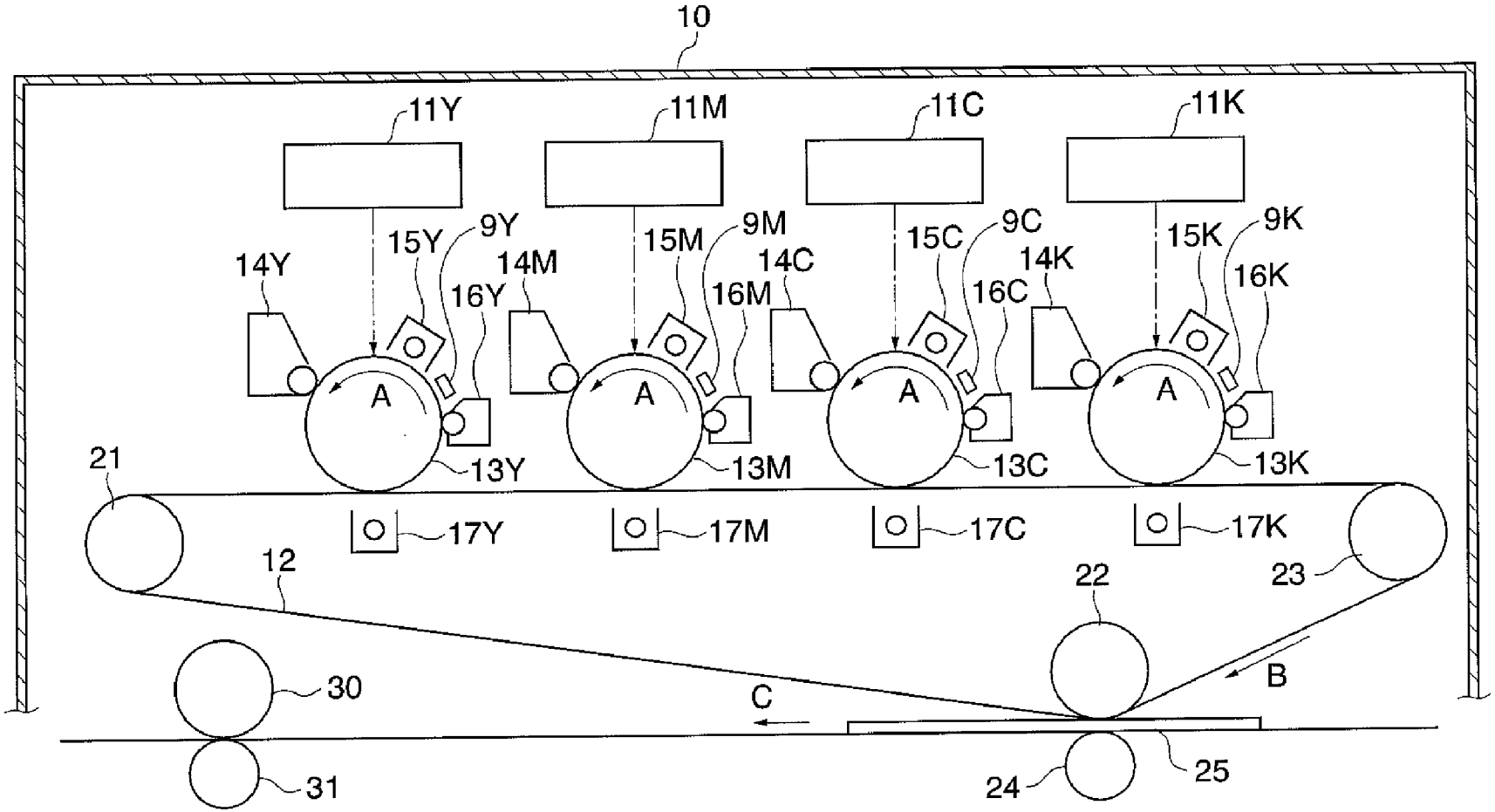
FIG. 1 is a structural view showing the construction of an image forming apparatus according to a first embodiment of this invention.

FIG. 1 shows the construction an image forming apparatus according to a first embodiment of this invention.

Referring to FIG. 1, the image forming apparatus 10 of this embodiment is configured as a laser beam printer for electrophotographic full color image formation, and includes image forming units, a transfer unit, a fixing unit, and a sheet feed unit. The image forming units for four colors (yellow (Y), magenta (M), cyan (C), and black (K)) are juxtaposed to one another and comprised of scanner units 11M to 11K, photosensitive drums 13Y to 13K, developing devices 14Y to 14K, and corona chargers 15Y to 15K.

The photosensitive drums 13Y to 13K (image carriers) are disposed at equal intervals in a direction shown by arrow B in which a transfer belt 12 is driven. Around the photosensitive drums 13Y to 13K, there are disposed the scanner units 11M to 11K, the developing devices 14Y to 14K (developing unit), and the corona chargers 15Y to 15K. The developing devices 14Y to 14K are fixedly disposed to face respective ones of outer peripheries of the photosensitive drums 13Y to 13K. The developing devices 14Y to 14K respectively contain Y, M, C and K toners. In the following, a process for forming Y, M, C and K toner images on respective ones of the photosensitive drums 13Y to 13K will be first described. Since methods for forming Y, M, C and K images are the same as one another, a method for M image formation will be described as an example.

The photosensitive drum 13M is formed at its surface with a photoconductive layer made of organic photoconducting material, and is rotatably driven by a drive mechanism (not shown) in a direction shown by arrow A. An electric charge remaining on the photosensitive drum 13M is first removed by an exposure section 9M (LED array or the like), and an electric charge is then uniformly applied onto the photosensitive drum 13M by the corona charger 15M. Next, a laser beam modulated in accordance with digital image data obtained by an image input unit (not shown) is output from the scanner unit 11M, thereby forming an electrostatic latent image on the photoconductive layer on the photosensitive drum 13M. Subsequently, a developing bias voltage is applied between the developing device 14M and the photosensitive drum 13M to thereby affix toner to the electrostatic latent image on the photosensitive drum 13M, whereby the electrostatic latent image is converted into a visual image.

The transfer unit includes the transfer belt 12, transfer chargers 17Y to 17K, and a recording sheet transfer roller 24. The transfer belt 12 is disposed to face the photosensitive drums 13Y to 13K, and is rotatably driven in the direction of arrow B by a driving mechanism (not shown) via rollers 21 to 23. The transfer chargers 17Y to 17K are respectively disposed to face the photosensitive drums 13Y to 13K with the transfer belt 12 therebetween. Visual images (Y, M, C, and K toner images) formed on the photosensitive drums 13Y to 13K are electrostatically attracted onto the one transfer belt 12 and superimposed one upon another by the transfer chargers 17Y to 17K, whereby one color toner image is formed. The recording sheet transfer roller 24 is disposed to face the roller 22, with the transfer belt 12 disposed therebetween.

The sheet feeding unit (not shown) transfers a recording sheet 25 by a transfer mechanism toward a nip portion between the recording sheet transfer roller 24 and the roller 22. The toner image on the transfer belt 12 is transferred onto the recording sheet 25 by the recording sheet transfer roller 24. The recording sheet 25 onto which the toner image is transferred is conveyed to the fixing unit in a direction shown by arrow C. The fixing unit includes an upper fixing roller 30 and a lower fixing roller 31. By the upper and lower fixing rollers 30 and 31, the toner image on the recording sheet is fixed to the recording sheet by heat and pressure. The recording sheet 25 to which the toner image is fixed is conveyed to the outside of the image forming apparatus or to a conveyance path (not shown) in the image forming apparatus.

Next, by taking the developing device 14M as an example from among the developing devices 14Y to 14K of the image forming apparatus, the construction and operation of the developing device 14M will be explained with reference to FIGS. 2 to 10.

Figure 2:
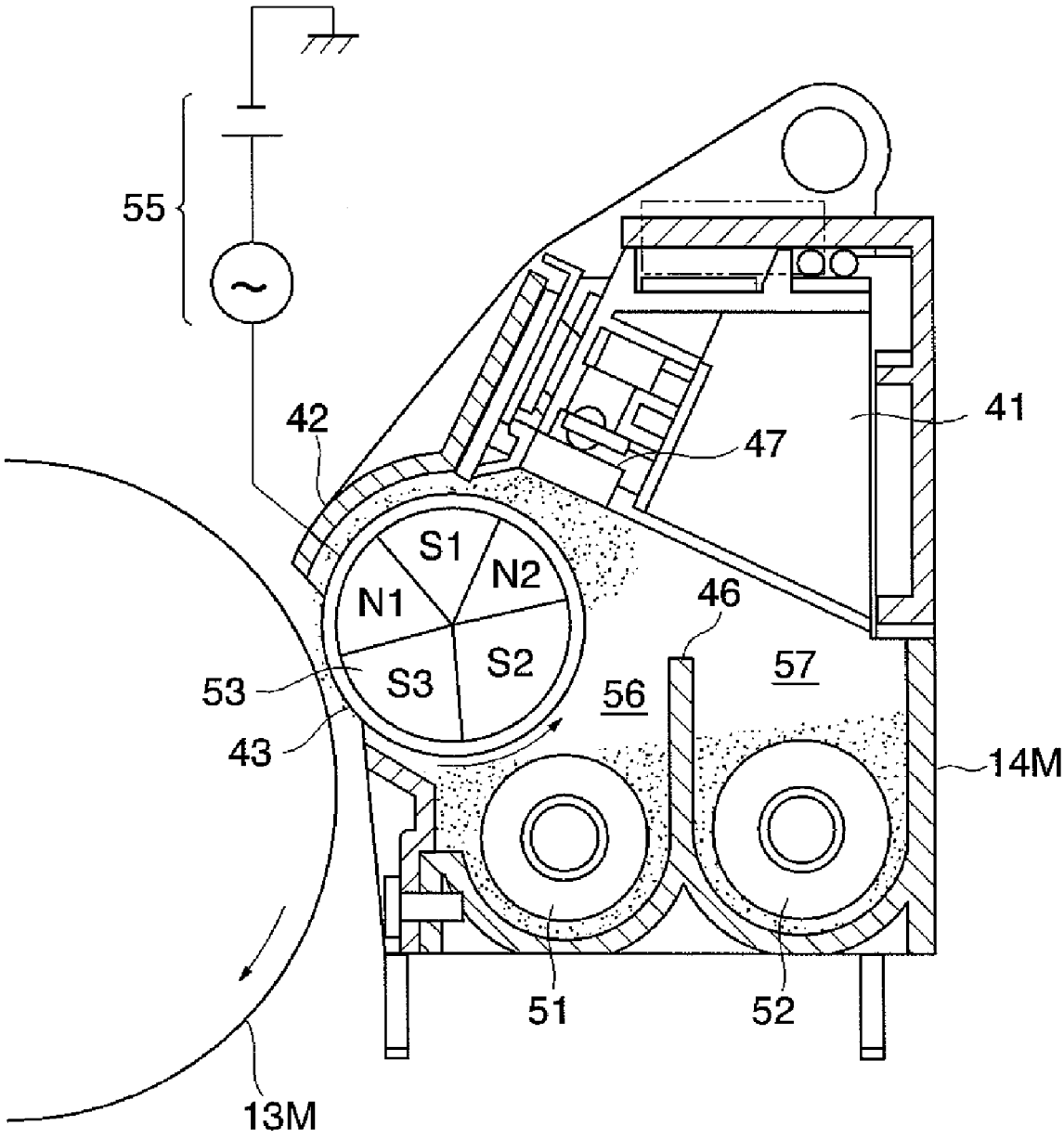
FIG. 2 is a section view showing the construction of a developing device of the image forming apparatus.

FIG. 2 shows in section view the construction of the developing device 14M of the image forming apparatus.

As shown in FIG. 2, the developing device 14M includes a developer return member 41, a blade 42, a developing sleeve 43, a toner density detection sensor 47 (detection unit), a shutter member 48 (FIG. 8), a first agitation transportation part 51, a second agitation transportation part 52, a magnet 53, a developing chamber 56, and an agitation chamber 57. The developer return member 41 regulates an amount of the developer between a developer supply position and an ear delimiting position where an ear of the developer is cut. The blade 42 regulates an ear height of the developer. The developing sleeve 43 is a developer carrying member on which the developer is carried. The toner density detection sensor 47 detects, as a toner density, a ratio between toner and carrier which form the two-component developer. The shutter member 48 prevents a sensor surface of the toner density detection sensor 47 from being contaminated.

The blade 42 is made of a non-magnetic material such as aluminum (Al), and is disposed on a rotationally upstream side of the developing sleeve 43 with respect to the photosensitive drum 13M. The blade 42 adjusts a gap between itself and a surface of the developing sleeve 43 to regulate a thickness of the developer to be conveyed on the developing sleeve 43 toward a developing region. In this embodiment, therefore, both the non-magnetic toner and the magnetic carrier are transported to the developing region, while passing between the tip end of the blade 42 and the developing sleeve 43.

The interior of the developing device 14M is separated by a vertically extending partition wall 46 into the developing chamber (first chamber) 56 and the agitation chamber (second chamber) 57. An open space is defined above the partition wall 46. If there is a surplus of two-component system developer in the developing chamber 56, the surplus developer can be recovered on the agitation chamber 57 side. The two-component system developer that contains non-magnetic toner and magnetic carrier is received in the developing chamber 56 and the agitation chamber 57. The first agitation transportation part 51 of a screw type is disposed in the developing chamber 56, and the second agitation transportation part 52 of a screw type is disposed in the agitation chamber 57.

The first agitation transportation part 51 agitates and transports the developer in the developing chamber 56. Under the control of a control unit (not shown), the second agitation transportation part 52 agitates and transports toner supplied from a toner supply tank (not shown) to an upstream side of the second agitation transportation part 52 and the developer present in the agitation chamber 57, thereby making the toner density uniform. The developing chamber 56 is formed with an opening at a position corresponding to the developing region facing the photosensitive drum 13M.

The developing sleeve 43 is disposed for rotation in a state partly exposed to the opening of the developing chamber 56. The developing sleeve 43 is made of a non-magnetic material, has a magnet 53 fixed therein for generating a magnetic field, and is rotatably driven in the direction of arrow during the developing operation. In this embodiment, the magnet 53 has a developing magnetic pole S1 and magnetic poles N1, S2, N2, S3 for transporting the developer.

The developing sleeve 43 carries and conveys a layer of the two-component system developer whose ear height (layer thickness) is regulated by the blade 42, and supplies the developer to the photosensitive drum 13M in the developing region facing the photosensitive drum 13M, thereby developing an electrostatic latent image. To improve the developing efficiency (the rate of applying toner to the electrostatic latent image), a developing bias voltage, which is a combination of a DC voltage and an AC voltage superimposed thereon, is applied from a power source 55 to the developing sleeve 43.

Figure 3:
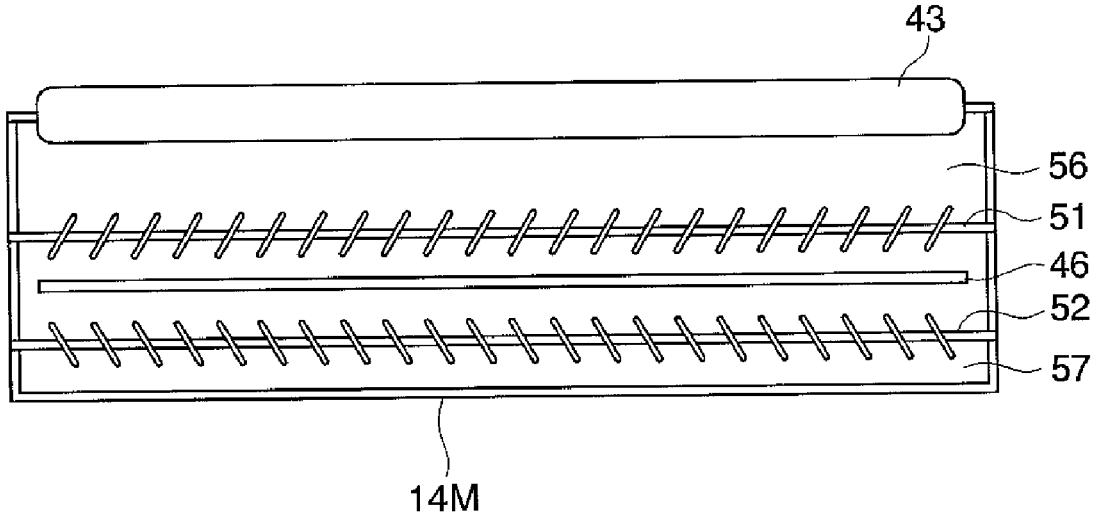
FIG. 3 is a section view showing the construction of a toner conveyance part of the developing device.

FIG. 3 shows in section view the construction of a toner conveyance part of the developing device 14M.

As shown in FIG. 3, a developer passage that connects the developing chamber 56 with the agitation chamber 57 is formed outward of longitudinally opposite ends (on the sides toward and away from the reader viewing FIG. 2) of the partition wall 46 of the developing device 14M. The developer in the developing chamber 56 whose toner density is lowered due to toner consumption by development is adapted to be moved toward inside the agitation chamber 57 by a conveyance force by the first and second agitation transportation parts 51, 52.

The first agitation transportation part 51 is disposed at the bottom of the developing chamber 56 along and substantially parallel to the axial direction (developing width direction) of the developing sleeve 43, and has a screw structure having a rotary shaft around which a spiral-shaped blade is provided. When being rotated, the first agitation transportation part 51 unidirectionally conveys the developer in the developing chamber 56 at the bottom of the developing chamber 56 in the axial direction of the developing sleeve 43.

The second agitation transportation part 52 is disposed at the bottom of the agitation chamber 57 substantially in parallel to the first agitation transportation part 51, and has a screw structure having a rotary shaft around which a spiral-shaped blade is provided in a spiral direction opposite from the spiral direction in which the blade of the first agitation transportation part 51 is provided. When being rotated in the same direction as the first agitation transportation part 51, the second agitation transportation part 52 transports the developer in the agitation chamber 57 in the direction opposite from the developer transportation direction by the first agitation transportation part 51. With the rotations of the first and second agitation transportation parts 51 and 52, the developer is circulated between the developing chamber 56 and the agitation chamber 57.

The developer in the developing chamber 56 is carried on the developing sleeve 43 by the action of the magnet 53 incorporated in the sleeve 43, and is conveyed toward the developing region in a state having a layer thickness regulated by the blade 42. Between the photosensitive drum 13M and the developing sleeve 43, the ear of the developer is raised along the magnetic flux of the magnetic field produced by the magnet 53 of the developing sleeve 43. By applying the developing bias voltage from the power supply 55 to the sleeve 43, the developer is transferred from the sleeve 43 to the drum 13M.

In this embodiment, the example has been described in which the toner density detection sensor 47 is made integral with the developing device 14M, however, this is not limitative. The sensor 47 may be configured to be separate from but adapted for attachment to the developing device 14M.

Figure 4:
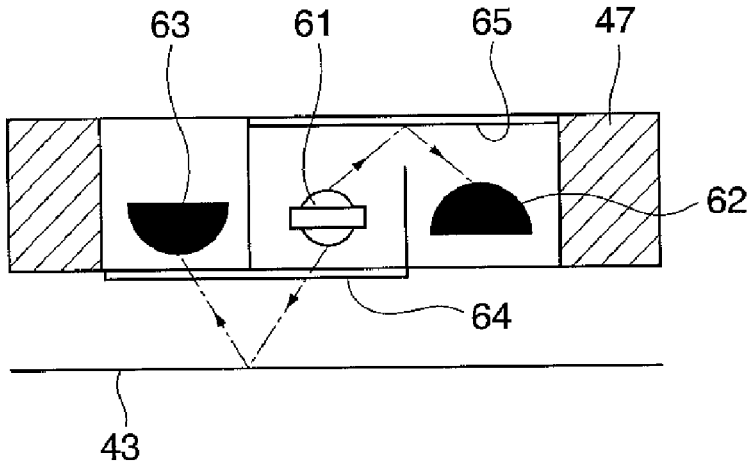
FIG. 4 is a view showing the construction of a toner density detection sensor.

FIG. 4 shows the construction of the toner density detection sensor 47.

As shown in FIG. 4, the toner density detection sensor 47 includes an emission LED 61 (light emission unit), a reference light receiving element 62, and a reflection light receiving element 63 (light receiving unit). The reference light receiving element 62 and the reflection light receiving element 63 are configured to have their detection surfaces which are 180 degree inverted from each other. A mirror sheet 65 having a high reflectance is affixed to an inner wall of the toner density detection sensor 47 that faces the detection surface of the reference light receiving element 62.

An opening is formed in that portion of the toner density detection sensor 47 facing the detection surface of the reflection light receiving element 63, and a permeable protective sheet 64 is affixed to the opening. Since the protective sheet 64 faces the developing sleeve 43, the protective sheet 64 must be formed by a non-electrostatic material to prevent charged toner from being electrostatically attached to the protective sheet 64. In addition, a partition wall is disposed between the reflection light receiving element 63 and the emission LED 61, whereby the reflection light receiving element 63 does not directly receive light from the emission LED 61.

Figure 5:
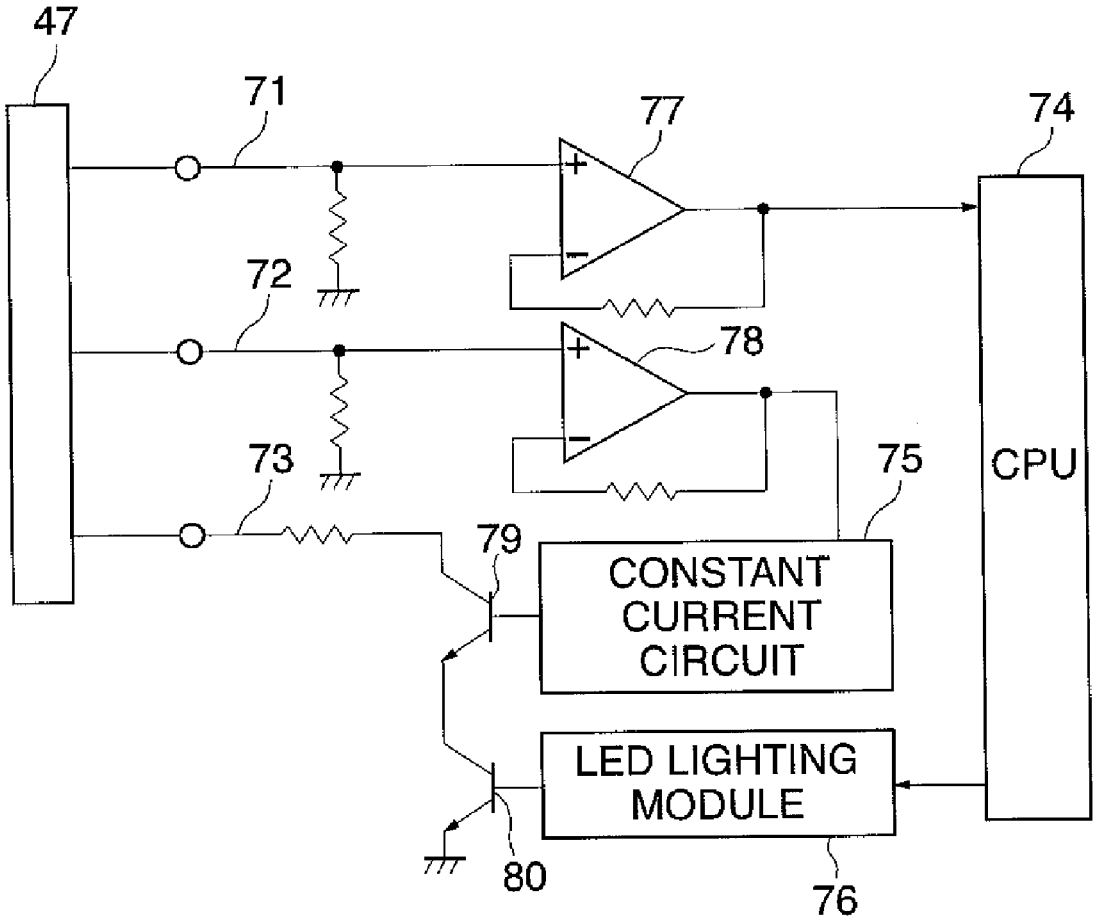
FIG. 5 is a block diagram showing a control circuit for the toner density detection sensor.

FIG. 5 shows in block diagram the construction of a control circuit for the toner density detection sensor 47.

As shown in FIG. 5, the toner density detection sensor control circuit includes a CPU 74 (determination unit), a constant current circuit 75, an LED lighting module 76, and circuit elements 77, 78, 79, and 80. The CPU 74, which is for controlling various parts of the control circuit, outputs a control signal to the LED lighting module 76. The CPU 74 implements a process shown in flowchart in FIG. 11 in accordance with a program. In accordance with the control signal output from the CPU 74, the LED lighting module 76 outputs an ON signal 73 to the toner density detection sensor 47. In the sensor 47, the emission LED 61 is lighted by the ON signal 73, and upon receipt of light from the emission LED 61, the reference light receiving element 62 outputs a reference output signal 72 to the constant current circuit 75.

The constant current circuit 75 compares a voltage represented by the reference output signal 72 with a predetermined voltage, and controls an electric current for the emission LED 61 of the toner density detection sensor 47 so as to be always equal to a predetermined value. Specifically, the constant current circuit 75 controls an amount of light emission from the emission LED 61 so as to always remain the same. In this state, the reflection light receiving element 63 of the sensor 47 receives reflection light from the object of detection (developing sleeve 43) and outputs an analog reflection signal 71 to the CPU 74. The CPU 74 employs the analog reflection signal 71 for the calculation of toner density.

Figure 6A:
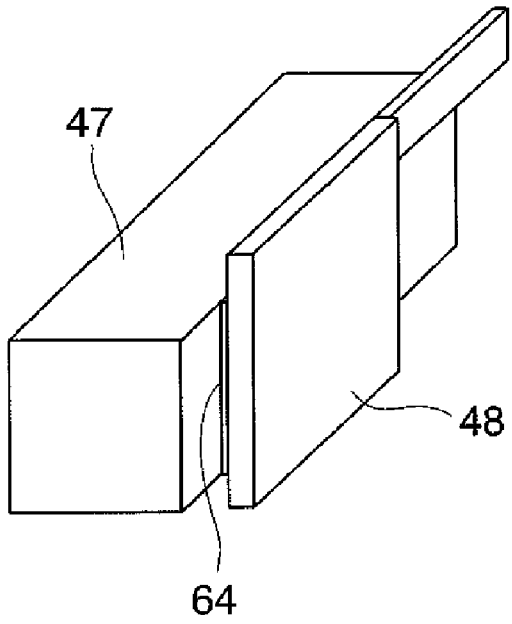
FIG. 6A is a view showing a shutter member for the toner density detection sensor in a closed state.
Figure 6B:
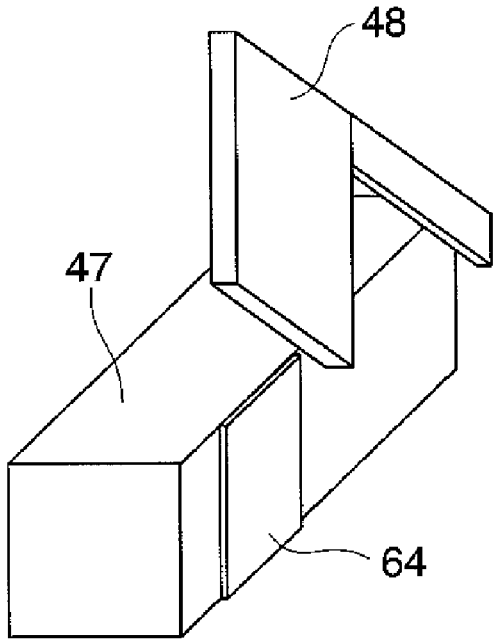
FIG. 6B is a view showing the shutter member for the toner density detection sensor in an open state.

FIG. 6A shows a state where the shutter member 48 for the toner density detection sensor 47 is closed, and FIG. 6B shows a state where the shutter member 48 is open.

As shown in FIGS. 6A and 6B, the shutter member 48 is disposed so as to cover the protective sheet 64 disposed in front of the detection surface of the reflection light receiving element 63 of the toner density detection sensor 47, and openably and closably protects the detection surface via the protective sheet 64. In a state that the shutter member 48 is closed (FIG. 6A), when the emission LED 61 of the sensor 47 is lighted, the reflection light receiving element 63 detects an amount of reflection light from a rear surface (i.e., a surface facing the protective sheet 64) of the shutter member 48. On the other hand, in a state that the shutter member 48 is open (FIG. 6B), the reflection light receiving element 63 is able to detect an amount of reflection light from the developer on the developing sleeve 43, which is the object of detection.

Figure 7:
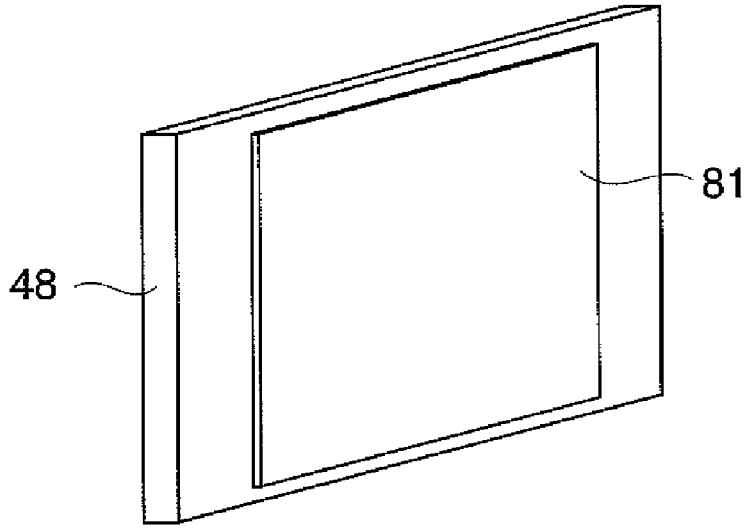
FIG. 7 is a perspective view showing a reflection sheet affixed to a surface of a shutter member on a side facing the toner density detection sensor.

FIG. 7 shows in perspective view a reflection sheet 81 affixed to a surface of the shutter member 48 on the side facing the toner density detection sensor.

As shown in FIG. 7, a thin reflection sheet 81 (reference member) is affixed to a surface of the shutter member 48 on the side facing the toner density detection sensor 47. The reflection sheet 81 has a size large enough to cover the entire surface of the opening in the sensor 47 facing the detection surface of the reflection light receiving element 63. An amount of reflection light from the reflection sheet 81 is substantially the same as an amount of reflection light from a developer having a predetermined toner density.

Figure 8:
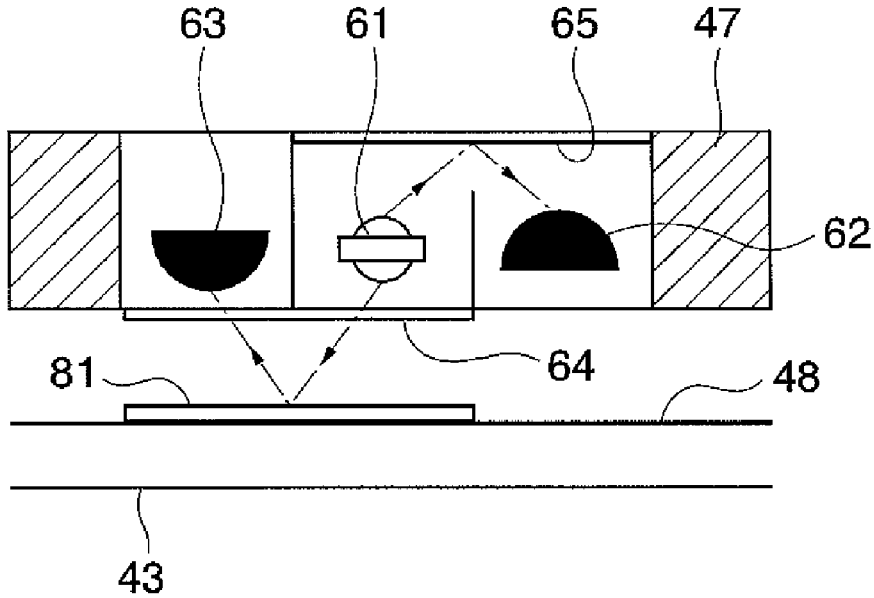
FIG. 8 is a view showing reflection from the reflection sheet performed when the shutter member is closed relative to the toner density detection sensor.

FIG. 8 shows reflection from the reflection sheet 81 performed when the shutter member 48 is closed relative to the toner density detection sensor 47.

As shown in FIG. 8, the shutter member 48 is disposed between the toner density detection sensor 47 and the developing sleeve 43. Light emitted from the emission LED 61 of the sensor 47 is reflected by the reflection sheet 81. The reflection light receiving element 63 of the sensor 47 receives reflection light from the reflection sheet 81 and outputs a reflection signal.

In FIG. 4, there is shown a positional relation found when the shutter member 48 and the reflection sheet 81 are open relative to the toner density detection sensor 47. The emission LED 61 and the reflection light receiving element 63 of the sensor 47 face the developing sleeve 43, and the reflection light receiving element 63 receives an amount of light reflected from toner carried on the developing sleeve 43 and outputs a reflection signal.

Figure 9:
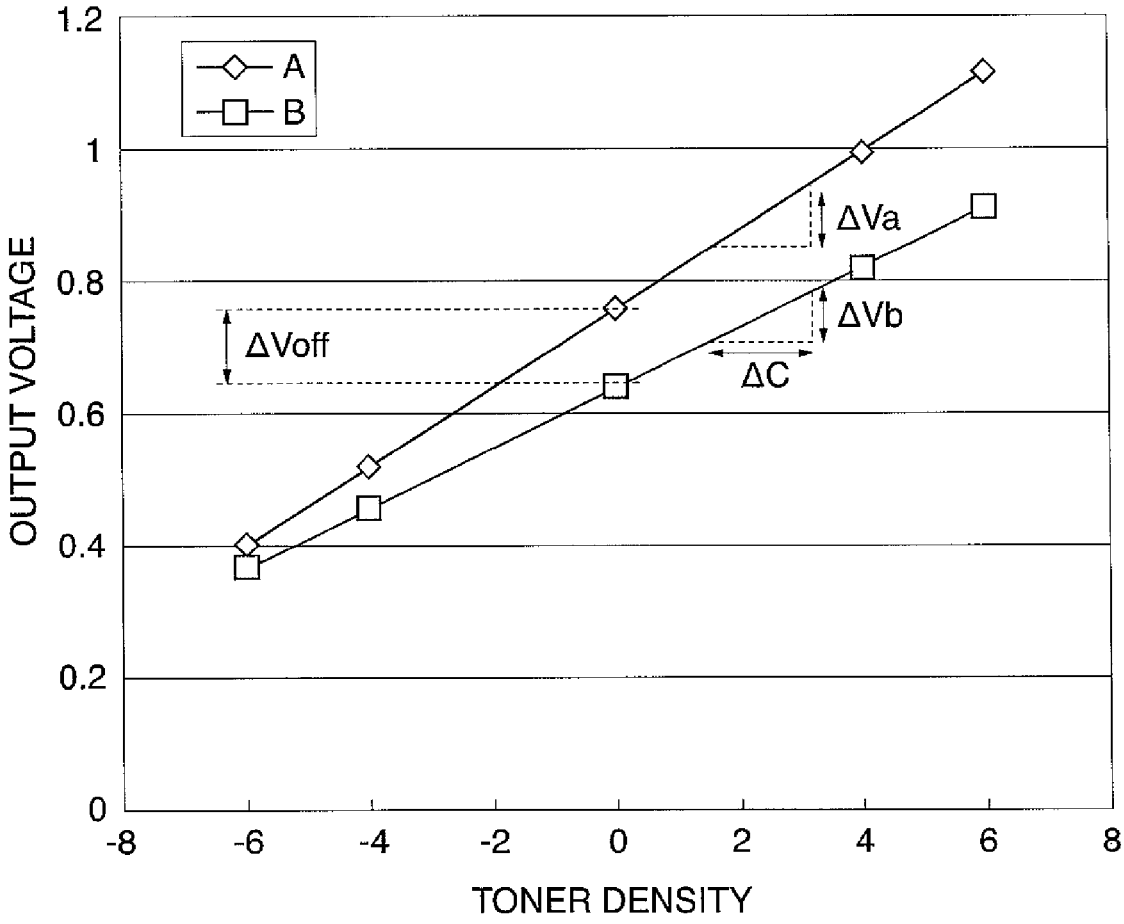
FIG. 9 is a view showing a relation between output voltage and toner density with respect to two toner density detection sensors having individual differences.

FIG. 9 shows a relation between output voltage and toner density with respect to two toner density detection sensors having individual differences.

In FIG. 9, two straight lines A, B respectively indicated by diamond-shaped marks and rectangle-shaped marks represent toner density vs. output voltage characteristics of two toner density detection sensors 47 (hereinafter referred to as the sensors A and B), which are different in lot number and have individual differences therebetween. The toner density (i.e., the ratio between toner and carrier of the two-component system developer, or the ratio of toner in the two-component system developer) is taken along the abscissa. The toner density of a new developer at factory shipment, etc. is represented by a value of 0. The output voltage of the reflection signal 71 output from the reflection light receiving element 63 of each toner density detection sensor 47 is taken along the ordinate, and output voltage values shown along the ordinate are a mere example.

There is a difference between the output voltage of the sensor A at toner density of zero and that of the sensor B at toner density of zero. Specifically, there is a relation of [Output voltage of sensor A at zero toner density]−[Output voltage of sensor B at zero toner density]=ΔVoff. In order to set an initial value of the toner density of a new developer to be equal to zero, an offset adjustment is performed when each developing device is assembled at a factory or replaced by a commercially available new developing device. If the sensor B is standard, the output voltage difference ΔVoff relative to the output voltage of the sensor B is read at the offset adjustment for the sensor A or other sensor.

Even after the offset adjustment, an amount of change in output voltage with the change in toner density is different between the sensors A, B. Assuming as shown for example in FIG. 9 that amounts of change in output voltage of the sensors A, B with a predetermined change ΔC in toner density are respectively represented by ΔVa and ΔVb, there is a relation of ΔVa>ΔVb. In that case, the larger the toner density, the larger the output voltage difference between the sensors A and B will be, and the larger the shift in the relation between output voltage and toner density will be. To prevent this, the reflection sheet 81 able to produce an amount of reflection light, which is coincident with that from a developer having a predetermined toner density, is attached to the shutter member 48 for the below-mentioned correction.

Figure 10:
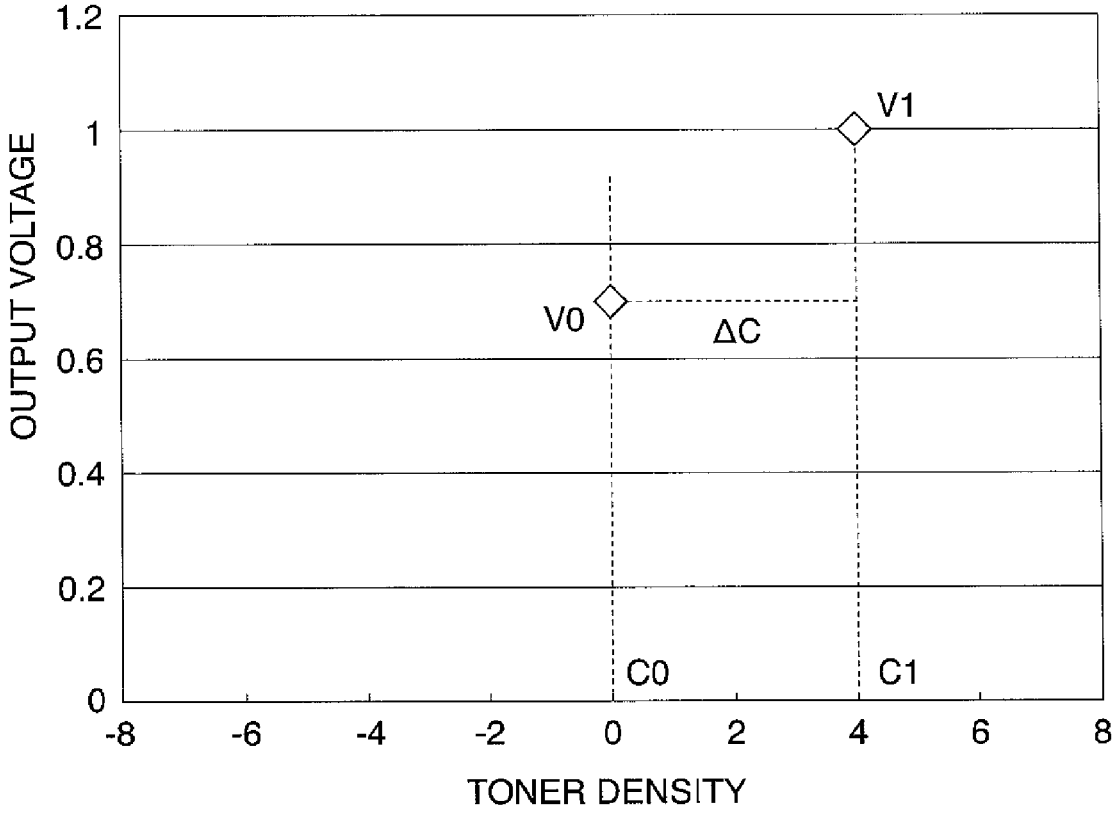
FIG. 10 is a view showing an output correction for the toner density detection sensor.

FIG. 10 shows an output correction for the toner density detection sensor 47.

In FIG. 10, there is shown a relation between output voltage and toner density in a case that output correction control for the toner density detection sensor 47 is carried out by using the reflection sheet 81 having an amount of reflection light larger than that attained by a developer having a toner density of zero. It should be noted that the reflection sheet 81 may have an amount of reflection light smaller than that attained by a developer having a toner density of zero. In that case, the output correction control for the toner density detection sensor 47 is carried out in the same manner as in the case of using the reflection sheet 81 having an amount of reflection light larger that attained by a developer having a toner density of zero. As explained above, the reflection sheet 81 has the amount of reflection light which is different from an amount of reflection light corresponding to a toner density reference point (a mid-value of toner density).

First, the CPU 74 of the toner density detection sensor control circuit causes the LED lighting module 76 to lighten the emission LED 61 of the toner density detection sensor 47 in a state that the shutter member 48 is closed. Thus, the reflection light receiving element 63 of the sensor 47 receives reflection light from the reflection sheet 81 and outputs an output voltage V1. The CPU 74 causes a memory (not shown) to hold the output voltage V1 and causes a shutter driving mechanism (not shown) to open the shutter member 48. As a result, the reflection light receiving element 63 of the sensor 47 receives reflection light from the developing sleeve 43 and outputs an output voltage V0. The CPU 74 causes the memory to hold the output voltage V0.

If a toner density corresponding to the amount of reflection light from the reflection sheet 81 is deviated by ΔC from the toner density of zero, the amount of change in output of the toner density detection sensor 47 per unit toner density, Vs, can be represented by (V1−V0)/ΔC. The amount of output change Vs has an abnormal value, if the toner density detection sensor 47 produces an abnormal output due to a faulty adjustment, etc., or if the shutter driving mechanism is broken. If the amount of voltage change Vs falls within a predetermined range from Vs0 to Vs1, the toner density detection sensor 47 is determined as being standard (OK). If the amount of voltage change Vs falls outside the predetermined range, the sensor 47 is determined as being nonstandard (NG) and an error determination is made. Preferably, the required action is taken, such as the operation of the main unit of the image forming apparatus being stopped.

Next, an output correction process for the toner density detection sensor 47 of this embodiment will be described.

Figure 11:
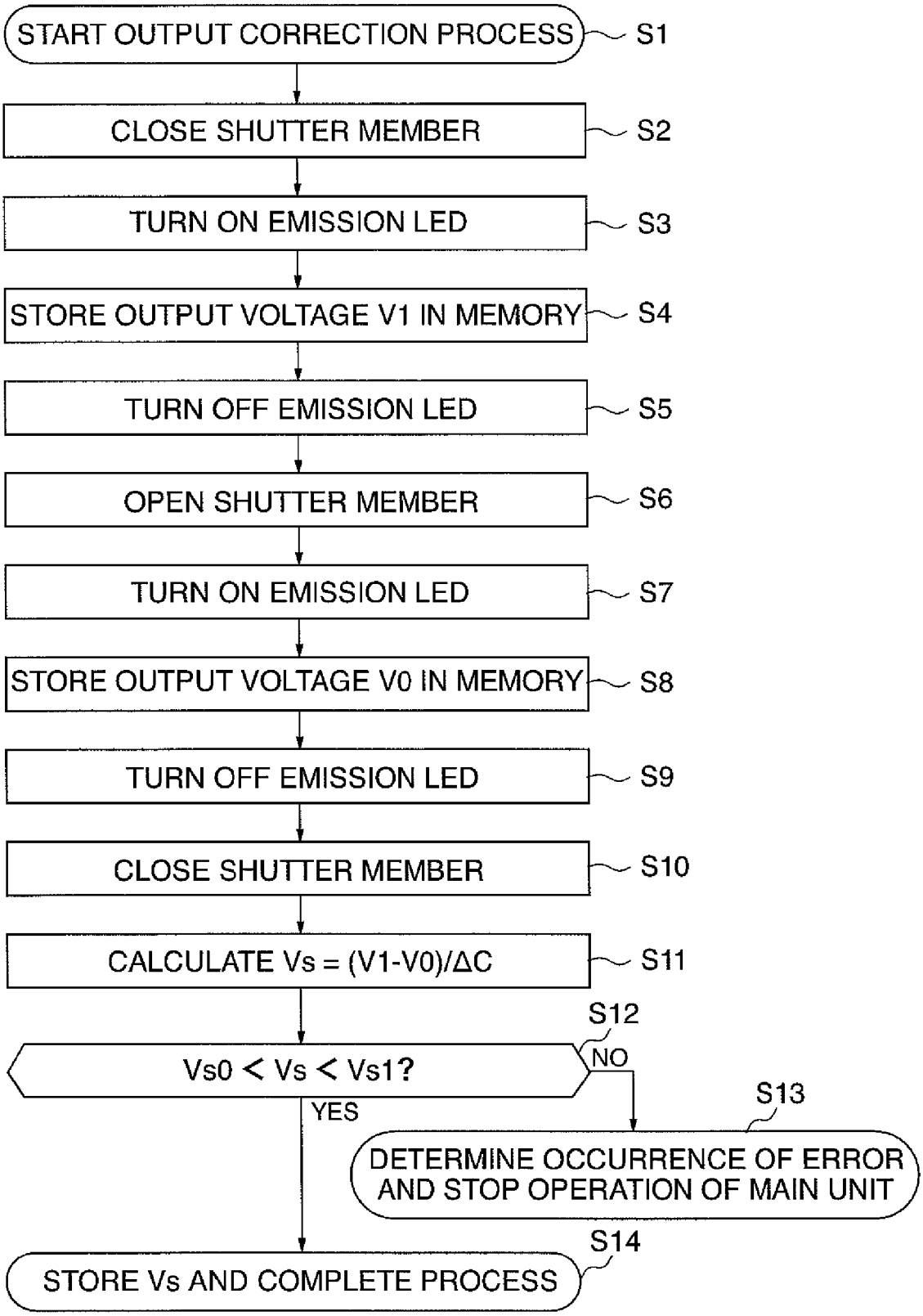
FIG. 11 is a flowchart showing an output correction process for the toner density detection sensor.

FIG. 11 shows in flow chart a process for correcting the output of the toner density detection sensor 47.

Referring to FIG. 11, the CPU 74 of the toner density detection sensor control circuit starts the output correction process (determination process) for the toner density detection sensor 47 (step S1). First, the CPU 74 controls the shutter driving mechanism (not shown) to close the shutter member 48 (step S2), whereby the state that the shutter member 48 is closed is ensured. Next, the CPU 74 turns on the emission LED 61 of the sensor 47 (step S3). The CPU 74 receives reflection light from the reflection sheet 81 at the reflection light receiving element 63 of the sensor 47, inputs an output voltage V1 from the reflection light receiving element 63, and stores the output voltage V1 into the memory, not shown (step S4).

Next, the CPU 74 turns off the emission LED 61 of the sensor 47 (step S5), and causes the shutter driving mechanism to open the shutter member 48 (step S6). Next, the CPU 74 again turns on the emission LED 61 of the sensor 47 (step S7). The CPU 74 causes the reflection light receiving element 63 of the sensor 47 to receive reflection light from the developing sleeve 43, inputs the output voltage V0 from the reflection light receiving element 63, and causes the memory to hold the output voltage V0 (step S8).

Next, the CPU 74 turns off the emission LED of the toner density detection sensor 47 (step S9), and brings the shutter member 48 into a closed state, i.e., the initial operation state, by the shutter driving mechanism (step S10). Next, in accordance with the output voltages V0, V1 stored in the memory, the CPU 74 calculates an amount of change in output of the sensor 47 per unit toner density, Vs (=(V1−V0)/ΔC) (step S11), and stores the amount of change Vs into the memory.

Next, the CPU 74 determines whether or not the amount of change in output per unit toner density, Vs, falls within the predetermined range from Vs0 to Vs1 (step S12). If it is determined that the amount of change in output per unit toner density, Vs, does not fall within the predetermined range, the CPU 74 determines an occurrence of an error and stops the operation of the main unit of the image forming apparatus (step S13). If, on the other hand, it is determined that the amount of change in output per unit toner density, Vs, falls within the predetermined range, the CPU 74 stores the amount of change Vs in the memory as usual, and completes the present process (step S14).

The value of amount of change in output per unit toner density, Vs, which is obtained in the output correction process for the toner density detection sensor 47 is used as follows: Specifically, the value of amount of change Vs is used for calculating a toner density based on an output voltage from the sensor 47 during the ordinary operation of the image forming apparatus, and is also used for calculating a limit level in accordance with which an error output is generated in the image forming apparatus in a case, for example, that toner is not supplied to the developing devices due to an abnormal toner supply operation or a faulty operation of the toner supply system.

A threshold value of the output voltage of the sensor 47 used to determine an occurrence of an error for example when the toner density in the developing devices is equal to a value of C1 (>C0) is represented by the sum of an output voltage V0 at the toner density of zero (corresponding to the toner density of C0) and a value of Vs/(C1−C0).

As described above, in this embodiment, the reflection sheet 81 whose amount of reflection light is substantially the same as that of a developer having a predetermined toner density is affixed to the shutter member 48 that opens and closes the detection surface of the toner density detection sensor 47. Based on the amount of reflection light from the reflection sheet 81 generated when light is irradiated from the toner density detection sensor 47 onto the reflection sheet 81, a correction is carried out for the sensor 47. As a result, the output value of the sensor 47 can accurately be associated with the toner density in consideration of a variation in output values between individual toner density detection sensors, whereby the toner density of the developer in each developing device can be detected with accuracy.

Furthermore, a positional relation between the detection surface of the toner density detection sensor 47 and the reflection sheet 81 can easily be set, and the output correction for the sensor 47 can be simplified.

When a toner density corresponding to the amount of reflection light from the reflection sheet 81 is deviated by $\Delta C$ from the toner density of zero, the amount of change in output of the sensor 47 per unit toner density, Vs, can be represented as $(V1-V0)/\Delta C$, thereby making it possible to accurately correct the output of the sensor 47.

Based on the amount of reflection light from the reflection sheet 81 obtained in a closed state of the shutter member 48 and the amount of reflection light from the developer obtained in an open state of the shutter member 48, the correction for the toner density detection sensor 47 is carried out, whereby the output of the sensor 47 can be easily corrected.

If the amount of change in output of the sensor 47 per unit toner density falls outside the predetermined range, the operation of the main unit of the image forming apparatus is stopped. It is therefore possible to prevent the image forming apparatus from being operated based on an improper correction value in such a case that the toner density detection sensor 47 or the drive of the shutter member 48 is in failure.

In summary, a variation in detection sensitivity between toner density detection sensors 47 that detect the toner densities of the developers in the developing devices can be corrected, and therefore, the toner densities of the developers in the developing devices can substantially accurately be determined. As a result, the criterion used in determining whether or not toner is properly supplied to the developing devices can be set individually for respective image forming apparatuses, and the toner densities of the developers in the developing devices can be stabilized. In addition, a problem in the prior art such that time and effort are required for the replacement of the toner density detection sensor and the developing devices and the offset adjustment can be eliminated.

Second Embodiment

Figure 12:
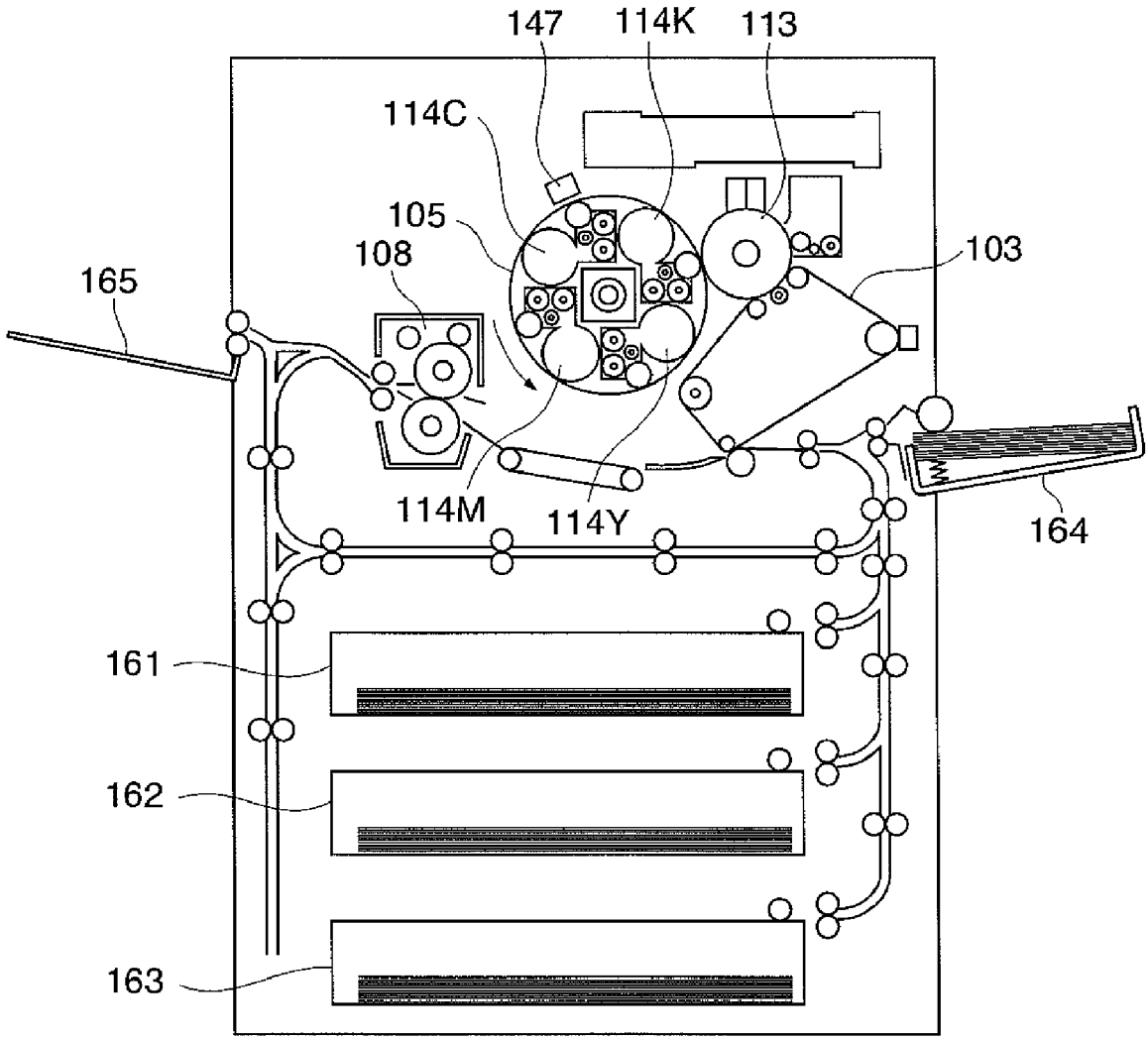
FIG. 12 is a structural view showing the construction of an image forming apparatus according to a second embodiment of this invention.

FIG. 12 shows in structural view the construction of an image forming apparatus according to a second embodiment of this invention.

Referring to FIG. 12, the image forming apparatus is configured as a copying machine comprised of an image reading unit for reading an image from an original, and an image forming unit for forming an image on a recording sheet. Specifically, the image forming apparatus includes the image forming unit having an intermediate transfer member 103, a developing rotary 105 (developing unit), and a photosensitive drum 113 (image carrier), and includes a fixing unit 108, sheet feeding units 161 to 163, a multi tray 164, a sheet discharge tray 165, etc. The developing rotary 105 includes four color developing devices 114Y, 114M, 114C, and 114K disposed in a circumferential direction, and is disposed to face an outer periphery of the photosensitive drum 113. A description on the image reading unit is omitted.

The sheet feeding units 161 to 163 are for housing recording sheets, and the sheet feeding unit 163 can optionally be connected. In accordance with sizes of recording sheets, a user can freely assign recording sheets to the sheet feeding unit 161 to 163. Recording sheets of various sizes can be set in the multi tray 164. Recording sheets housed in the sheet feeding units 161 to 163 and the multi tray 164 are each picked up by corresponding ones of motor-driven conveyance rollers and conveyed to the image forming unit via conveyance paths.

The following is a description of the outline of image formation. A CPU (not shown) reads out image data stored in a memory, converts a digital signal into an analog signal, and causes an optical irradiation unit to irradiate a laser beam onto the photosensitive drum 113 to form thereon an electrostatic latent image. Next, the electrostatic latent image is developed by the developing devices 114Y to 114K with toners, and a toner image transferred to the intermediate transfer member 103 is transferred onto a recording sheet, the toner image on the recording sheet is fixed thereon by the fixing unit 108. Subsequently, the recording sheet is discharged to the sheet discharge tray 165. The details will be described below.

Figure 13:
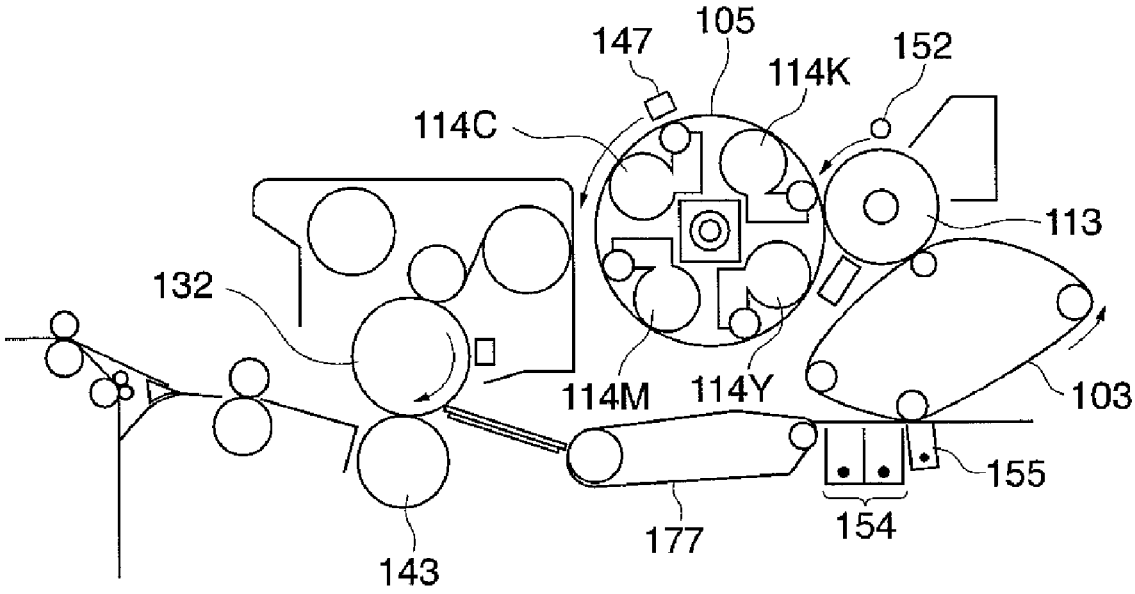
FIG. 13 is a view showing the construction of an image forming unit of the image forming apparatus.

FIG. 13 shows the construction of the image forming unit of the image forming apparatus.

Referring to FIG. 13, the photosensitive drum 113 is formed at its surface with a photoconductive layer made of an organic photoconducting material, and is rotatably driven by a drive motor (not shown) at a constant speed in a direction shown by arrow during execution of a copy job. The developing rotary 105 is disposed in contact with the photosensitive drum 113, and is rotatably driven by a drive motor (not shown) via a rotary shaft in a direction shown by arrow. In this embodiment, the developing rotary 105 includes the four color developing devices 114Y to 114K. However, the number of colors is not limited to four.

A toner density detection sensor 147 (detection unit) is disposed to face the outer periphery of the developing rotary 105, and detects the toner densities of developers on developing sleeves respectively provided in the developing devices 114Y to 114K. The intermediate transfer member 103 is disposed in contact with the photosensitive drum 113, and is formed by an endless belt-shaped member which is rotatably driven by a drive motor (not shown) in a direction shown by arrow. An exposure section 152 is disposed to face the outer periphery of the photosensitive drum 113.

The following is a description of development and transfer in the image forming unit. First, a residual electric charge remaining on the photosensitive drum 113 is removed by the exposure section 152, and an electric charge is uniformly applied to the photosensitive drum 113 by a primary charger. A laser beam modulated in accordance with image data stored in a memory is output from an optical irradiation section, whereby an electrostatic latent image is formed on the photoconductive layer of the photosensitive drum 113. The developing rotary 105 is rotated such that the desired developing device is brought in contact with the photosensitive drum 113, and toner from the developing device is adhered to the electrostatic latent image on the photosensitive drum 113, whereby the electrostatic latent image is converted into a visual image.

When the visual image on the photosensitive drum 113 reaches a contact part with the intermediate transfer member 103, the visual image is transferred by a primary transfer charger onto the intermediate transfer member 103. Extra toner not transferred onto the intermediate transfer member 103 is recovered, and a residual electrical charge on the photosensitive drum 113 is removed by the exposure section 152.

A similar operation is repeated for each of the developing devices 114Y to 114K of the developing rotary 105, whereby images of plural colors are superimposed one upon another for image formation on the intermediate transfer member 103.

On the other hand, a recording sheet fed from any of the sheet feeding units 161 to 163 and the multi tray 164 is conveyed below the intermediate transfer member 103 in time with the formation of the visual image. Then, the recording sheet is electrically charged by a secondary transfer charger 155, and the visual image on the intermediate transfer member 103 is transferred onto the recording sheet. Subsequently, to improve the ability of separation of the recording sheet from the intermediate transfer member 103, the recording sheet is electrically charged by a detach charger 154. The recording sheet detached from the intermediate transfer member 103 is conveyed by a conveyance belt 177 and guided between a fixing roller 132 and a pressurizing roller 133 of the fixing unit 108. The recording sheet onto which unfixed toner image is thermally fixed passes through a sheet discharge sensor (not shown) and is discharged to the sheet discharge tray 165.

Figure 14:
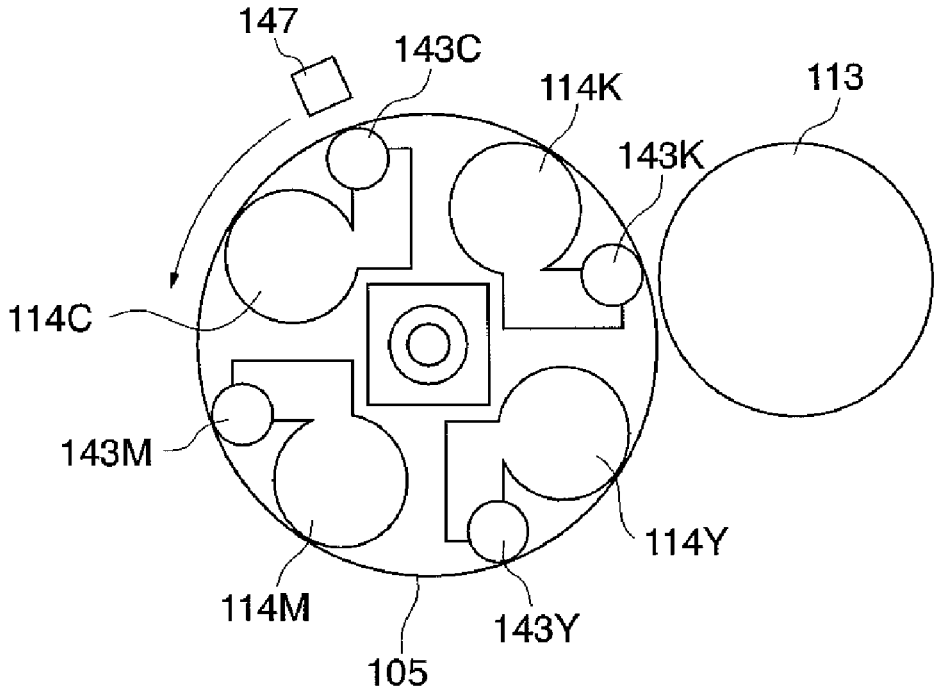
FIG. 14 is a view showing the construction of a developing rotary of the image forming unit.

FIG. 14 shows the construction of the developing rotary 105 of the image forming unit.

As shown in FIG. 14, the four color developing devices 114Y to 114K are disposed in the developing rotary 105 at equal intervals in a circumferential direction. The developing devices 114Y to 114K include developing sleeves 143Y to 143K, respectively. The developing rotary 105 includes a home position sensor (not shown) disposed at a predetermined location, and is stopped at a position detected by the home position sensor, whereby a developing position relative to the photosensitive drum 113 is uniquely determined. The developing rotary 105 can be rotated by a drive motor by a predetermined angle, whereby the desired color developing device can be brought to face the photosensitive drum 113.

FIG. 14 shows a state where the black developing device 114K is in the developing position facing the photosensitive drum 113. By rotating the developing rotary 105 by 90 degrees in a direction of arrow, the yellow developing device 114Y is moved to the developing position facing the photosensitive drum 113. The toner density detection sensor 147 is disposed to face the developing device at a location substantially 90 degrees downstream of the developing position in the photosensitive drum 113 as viewed in the rotational direction. Therefore, when the black developing device 114K is at the developing position, the sensor 147 is able to monitor the cyan developing device 114C. The sensor 147 may be disposed at a location different from the location substantially 90 degrees deviated from the developing position.

The developing devices 114Y to 114K each include a developer return member, a blade, a developing sleeve, a shutter member, first and second agitation transportation parts, a magnet, a developing chamber, and an agitation chamber (none of which is shown). The developing devices 114Y to 114K are the same in construction as the developing devices 14Y to 14K of the first embodiment (FIG. 2) except that each of the devices 114Y to 114K does not include the toner density detection sensor 47, and therefore an illustration and a description thereof are omitted. By the magnet arranged in each of the developing devices 114Y to 114K, an ear of the developer is raised between the developing sleeve and the photosensitive drum 113.

The toner density detection sensor 147 includes an emission LED, a reference light receiving element, and a reflection light receiving element (none of which is shown). The construction of the toner density detection sensor 147, a control circuit for the sensor 147, a variation in the relation between output voltage and toner density caused by an individual difference between sensors 147 are the same as those in the first embodiment (FIGS. 4, 5, and 9), and therefore illustrations and descriptions thereof are omitted. The rotational angular position of the developing rotary 105 relative to the toner density detection sensor 147 is adjusted so that the sensor 147 is able to detect ears of developers on the developing sleeves of the developing devices 114Y to 114K.

As described in the first embodiment (FIG. 9), the larger the toner density, the larger the difference between output voltages of toner density detection sensors (the sensors A, B) will be, and the larger the shift of the relation between output voltage and toner density will be. To prevent a variation in amount of output voltage change, a reflection sheet 159 used for the below-mentioned correction is affixed to the developing rotary 105 as shown in FIG. 15.

Figure 15:
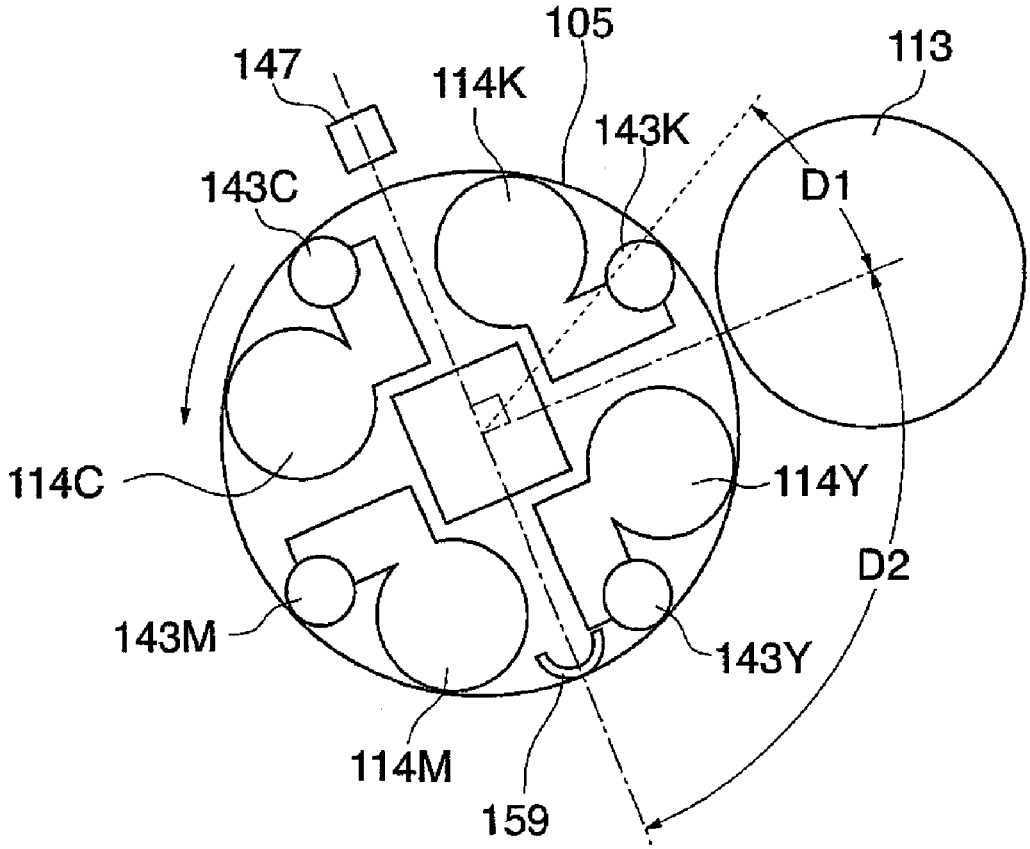
FIG. 15 is a view showing an affixed position of a reflection sheet of the developing rotary.

FIG. 15 shows a position where the reflection sheet 159 of the developing rotary 105 is affixed.

As shown in FIG. 15, the reflection sheet 159 (reference member) is affixed to an outer periphery of the developing rotary 105. When the developing rotary 105 is at the home position, the developing sleeve 143K of the black developing device 114K is deviated from the photosensitive drum 113 by an angle of D1.

In this embodiment, the reflection sheet 159 is disposed between the developing sleeve 143Y of the yellow developing device 114Y and the developing sleeve 143M of the magenta developing device 114M, and is at a position lag behind the home position of the developing rotary 105 by an angle of D2. The location at which the reflection sheet 159 is disposed is not limited to between the yellow developing device 114Y and the magenta developing device 114M, but may be disposed between any adjacent pair of developing devices.

Figure 16A:
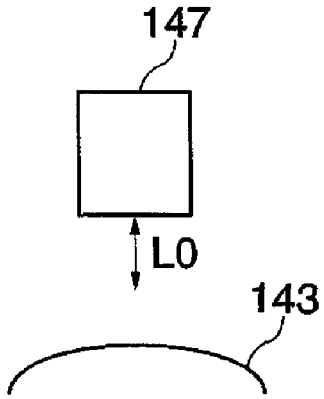
FIG. 16A is a view showing a positional relation between a toner density detection sensor and a developing sleeve.
Figure 16B:
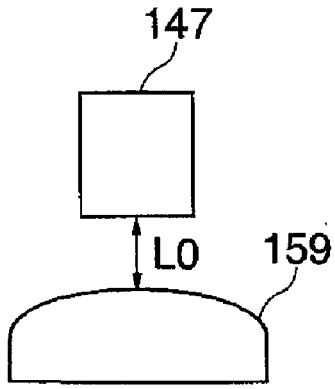
FIG. 16B is a view showing a positional relation between the toner density detection sensor and the reflection sheet.

FIG. 16A shows a positional relation between the toner density detection sensor 147 and developing sleeves 143Y to 143K (correctively referred to as the developing sleeves 143), and FIG. 16B shows a positional relation between the sensor 147 and the reflection sheet 159.

Referring to FIG. 16A, ears (not shown) of developers are formed on the developing sleeves 143 of the developing devices 114Y to 114K by the effects of the magnets, as described above. The height of ears of the developers is always regulated to a fixed height by regulating plates (not shown) in the developing devices. Symbol L0 represents a distance between the tip end of ear of the developer on the developing sleeve 143 and the detection surface of the sensor 147. The reflection sheet 159 is also disposed at the distance L0 from the detection surface of the sensor 147.

The height of the ear of the developer is set to such a height that a gap is formed between the ear of the developer and the surface of the photosensitive drum 113 when the ear of the developer faces the photosensitive drum 113. As a result, even if the reflection sheet 159 is disposed at the same height level as the ear of the developer, the photosensitive drum 113 never be damaged. The reflection sheet 159 has a reflectance corresponding to a predetermined toner density, and there is a difference in reflectance between colors. The predetermined toner densities for respective colors are respectively deviated by $\Delta Cy$, $\Delta Cm$, $\Delta Cc$, and $\Delta Ck$ from a toner density reference point. In the example of this embodiment, the predetermined toner densities are deviated from the toner density reference point in the increasing (dense) direction. However, the predetermined toner densities may be deviated from the toner density reference point in the decreasing (light) direction without any problem.

In the following, a description will be given of an operation of correcting the output of the toner density detection sensor 147. An operation for output correction is carried out upon assembly of a product (image forming apparatus) or upon replacement of the toner density detection sensor. Before the output correction operation, new developers are installed in the developing devices.

Figure 17:
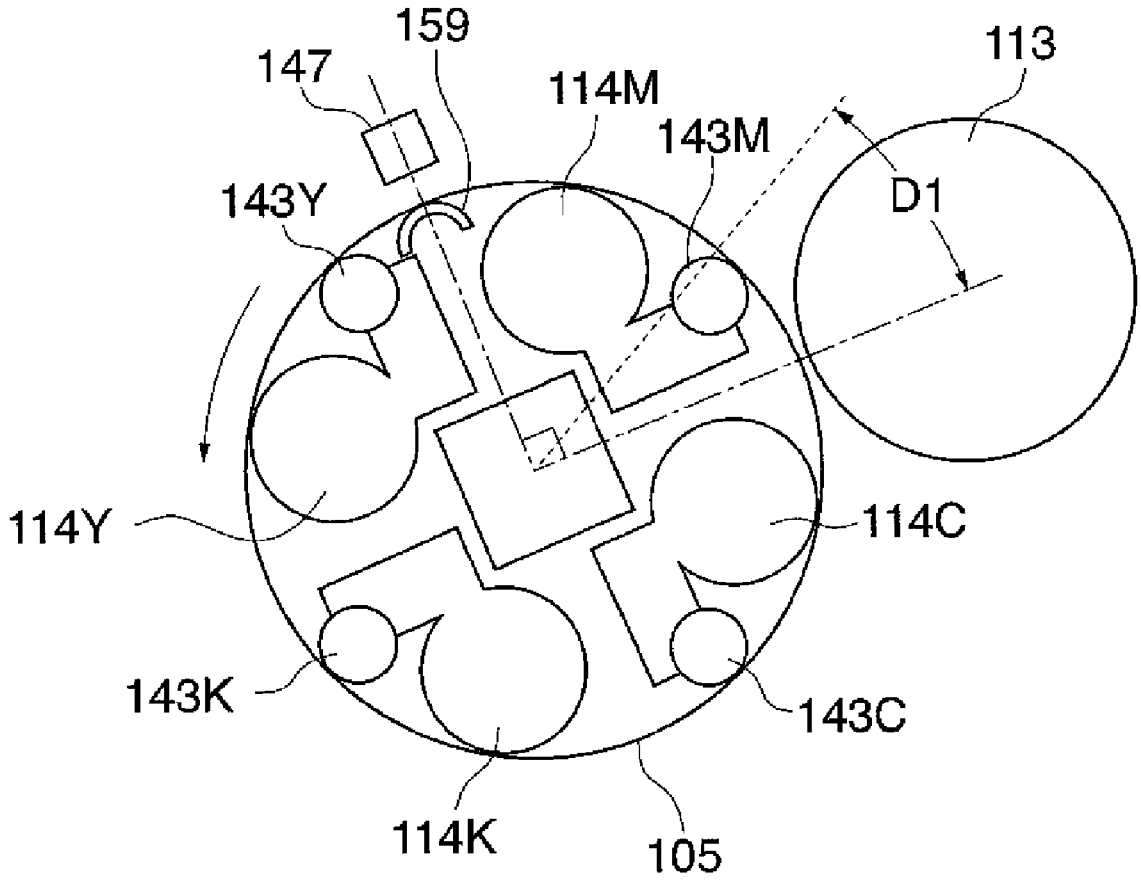
FIG. 17 is a view showing a state where the reflection sheet is caused to face the toner density detection sensor at the time of output correction for the sensor.

FIG. 17 shows a state where the reflection sheet 159 is caused to face the toner density detection sensor 147 at the time of the output correction for the sensor 147.

Referring to FIG. 17, a CPU (not shown) of a toner density detection sensor control circuit causes a drive motor to rotatably drive the developing rotary 105 by an angle of (90+D2) degrees from the home position (FIG. 15) in a direction shown by arrow, whereby the reflection sheet 159 is brought to face the toner density detection sensor 147. Next, the CPU causes the LED lighting module to lighten the emission LED of the sensor 147. Thus, the reflection light receiving element of the sensor 147 receives reflection light from the reflection sheet 159, and outputs an output voltage V1 (reflection signal). The CPU stores the output voltage V1 into a memory.

Next, the CPU causes the developing sleeves of the developing devices 114Y to 114K to face the toner density detection sensor 147 in sequence. The reflection light receiving element of the sensor 147 therefore receives reflection light from each of the developing sleeves, and outputs an output voltage V0 (reflection signal). The CPU stores the output voltage V0 into the memory.

It is assumed that the toner density detection sensor 147 outputs the output voltage Vy0, Vm0, Vc0, or Vb0 when receiving reflection light from the developing sleeve of each of the yellow, magenta, cyan, and black developing devices 114Y to 114K. The CPU causes the memory to hold the output voltages Vy0, Vm0, Vc0, and Vb0. Since it is known that the reflectances of the reflection sheet 159 corresponds to ΔCy, ΔCm, ΔCc, and ΔCb calculated in terms of toner density from a zero density level, the CPU determines gradients of toner density vs. output voltage characteristics for respective colors from these characteristics.

Provided that the toner density is the same between yellow, magenta, and cyan toners, the output voltages of the toner density detection sensor 147 indicating the amounts of reflection light from developers become substantially the same level. Thus, as a representative of yellow, magenta, and cyan, the output voltage of the toner density detection sensor 147 may be determined with respect to either one of these colors. With regard to black, there is a tendency that the output voltage becomes lower in level than those for the other colors at the same toner density. It is therefore necessary for the black toner density corresponding to the amount of reflection light from the reflection sheet 159 to be set at a higher level than toner density levels for the other colors.

Figure 18:
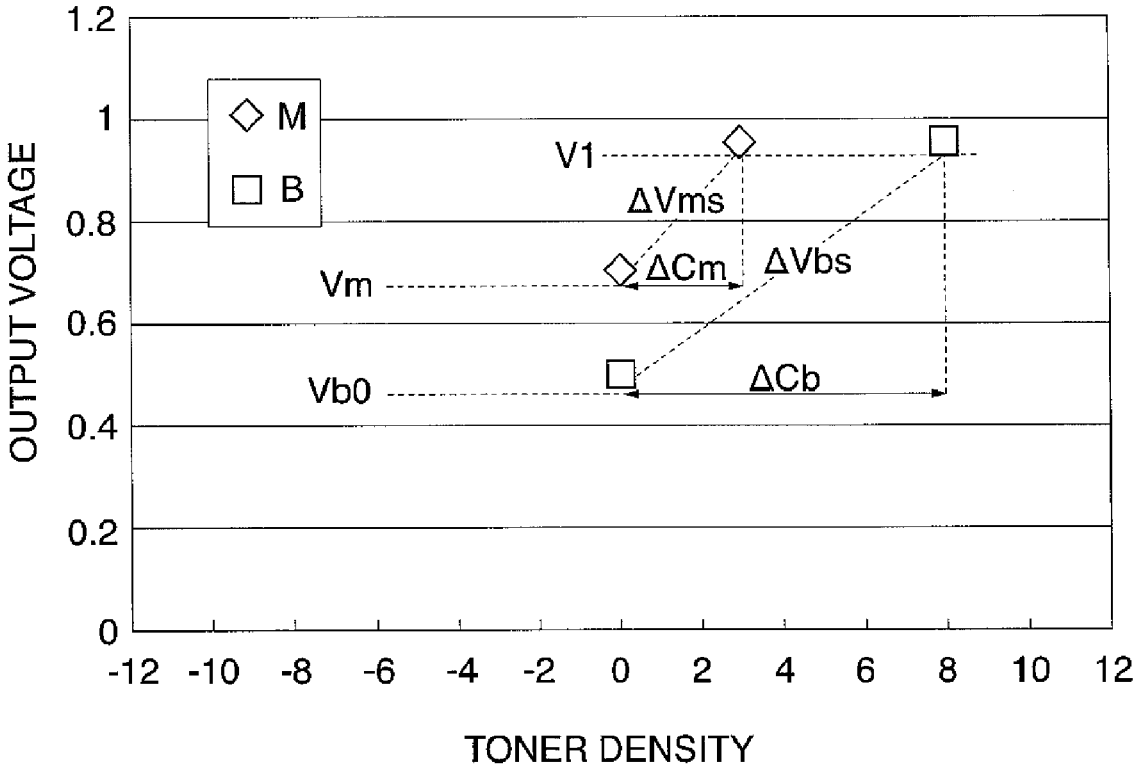
FIG. 18 is a view showing a relation between output voltage of the toner density detection sensor and toner density.

FIG. 18 shows a relation between output voltage of the toner density detection sensor 147 and toner density.

Referring to FIG. 18, there is shown a magenta toner density vs. output voltage characteristic indicated by diamond-shaped marks, which is a representative of yellow, magenta, and cyan toner density vs. output voltage characteristics. Also, a black toner density vs. output voltage characteristic indicated by rectangle-shaped marks is shown. The gradient of toner density vs. output voltage characteristic is different between magenta and black. The magenta characteristic gradient ΔVms can be represented by ΔVms=(V1−Vm0)/ΔCm. On the other hand, the black characteristic gradient ΔVbs can be represented by ΔVbs=(V1−Vb0)/ΔCb. With respect to yellow and cyan, the gradient of toner density vs. output voltage characteristic can similarly be calculated.

In this embodiment, the amount of reflection light (output) from the reflection sheet 159 is set so as to be larger than that at the toner density reference point (mid-value of toner density). However, there may be used a reflection sheet having an amount of reflection light lower than that at the toner density reference point. In that case, the gradients of the cyan and black toner density vs. output voltage characteristics are respectively represented by ΔVms=(Vm0−V1)/ΔCm and ΔVbs=(Vb0−V1)/ΔCb.

In consideration of a case where a normal value cannot be detected due to a failure in the toner density detection sensor 147 or in the drive system of the developing rotary 105, when the gradient of toner density vs. output voltage characteristic falls outside a predetermined range, an occurrence of an error is determined and the operation of the main unit of the image forming apparatus is stopped.

Next, an output correction process for the toner density detection sensor 147 of this embodiment will be described.

Figure 19:
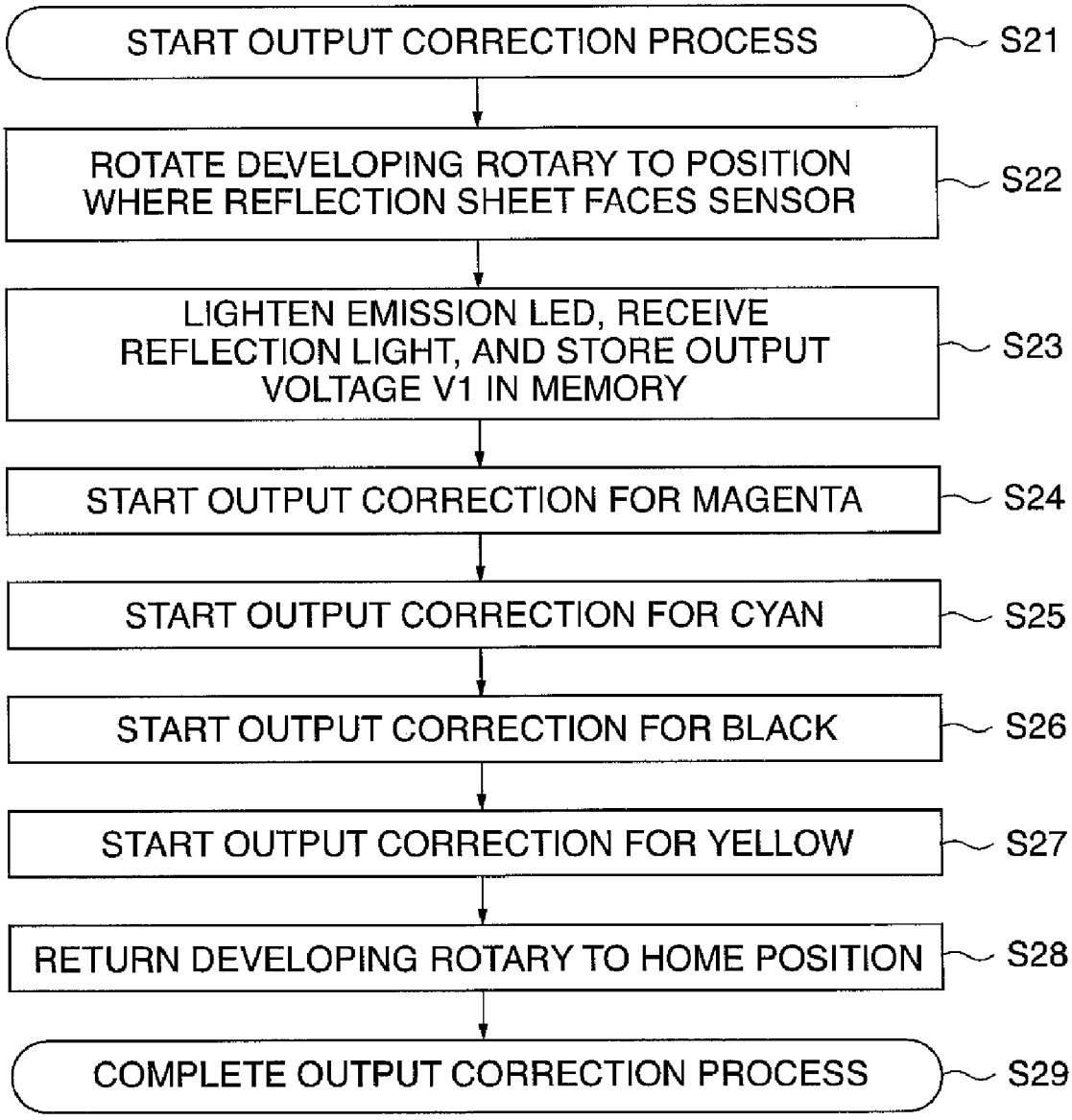
FIG. 19 is a flowchart showing an output correction process for the toner density detection sensor.

FIG. 19 shows in flowchart the output correction process for the toner density detection sensor 147.

As shown in FIG. 19, the CPU of the toner density detection sensor control circuit starts the output correction process (determination process) for the toner density detection sensor 147 (step S21). First, the CPU rotatably drives the developing rotary 105 so as to move the developing rotary 105 to a position where the reflection sheet 159 faces the sensor 147 and stops the developing rotary 105 there (step S22). Next, the CPU lightens the emission LED of the sensor 147, causes the reflection light receiving element of the sensor 147 to receive reflection light from the reflection sheet 159, and holds an output voltage V1 of the sensor 147 into a memory (step S23).

Next, the CPU starts the output correction process for the toner density detection sensor 147 with respect to the magenta developing device 114M, which is disposed closest to the reflection sheet 159 (see, FIG. 15) (step S24). The output correction process for the sensor 147 with respect to the magenta developing device 114M will be described later with reference to FIG. 20. After completion of the output correction process with respect to the magenta developing device 114M, the CPU starts the output correction process for the sensor 147 with respect to the cyan developing device 114C disposed close to the magenta developing device 114M (step S25).

Next, the CPU starts the output correction process for the sensor 147 with respect to the black developing device 114K (step S26). Then, the CPU starts the output correction process for the sensor 147 with respect to the yellow developing device 114Y (step S27). Finally, the CPU returns the developing rotary 105 to the home position (step S28), and completes the output correction process (step S29).

Figure 20:
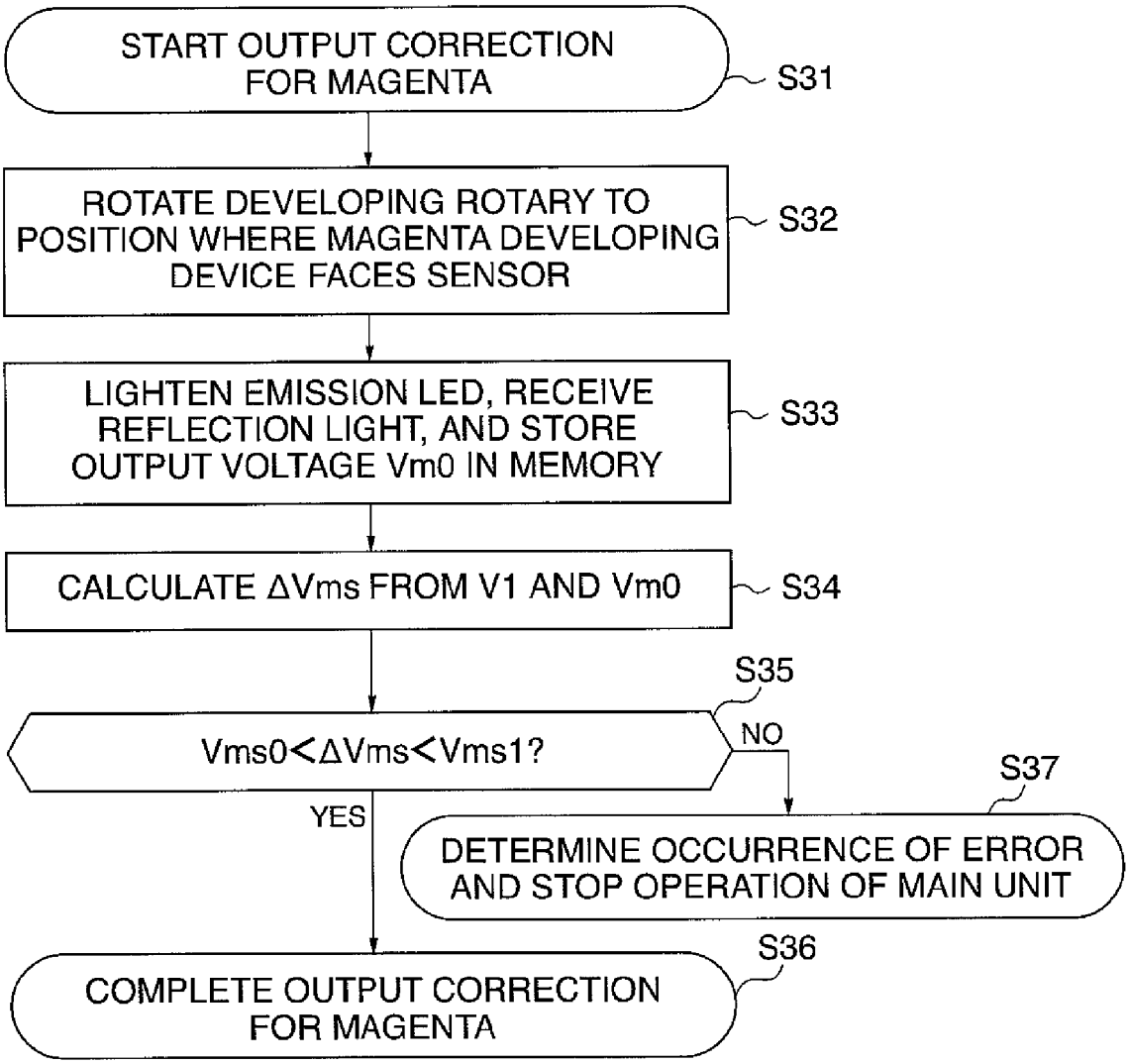
FIG. 20 is a flowchart showing the details of the output correction process for the sensor with respect to a magenta developing device.

FIG. 20 shows in flowchart the details of the output correction process for the toner density detection sensor 147 with respect to the magenta developing device 114M.

Referring to FIG. 20, the CPU starts the output correction process for the sensor 147 with respect to the magenta developing device 114M (step S31). First, the CPU rotatably drives the developing rotary 105 so as to move the developing sleeve 143M of the magenta developing device 114M to a position in which the developing sleeve 143M faces the sensor 147, and stops the developing rotary 105 there (step S32). Next, the CPU lightens the emission LED of the sensor 147. Then, the CPU causes the reflection light receiving element of the sensor 147 to receive reflection light from the developer of the developing sleeve 143M, and stores an output voltage Vm0 of the toner density detection sensor 147 into the memory (step S33).

Based on the output voltage V1 stored into the memory in step S23 in FIG. 19 and the output voltage Vm0 stored into the memory in step S33, the CPU calculates the gradient ΔVms of the magenta toner density vs. output voltage characteristic (step S34). Then, the CPU determines whether or not the gradient ΔVms of the magenta toner density vs. output voltage characteristic falls within a predetermined range from Vms0 to Vms1 (step S35).

If it is determined that the gradient ΔVms of the magenta toner density vs. output voltage characteristic does not fall within the predetermined range, the CPU determines an occurrence of an error due to a failure in the toner density detection sensor 147 or in the developing rotary 105, and stops the operation of the main unit of the image forming apparatus (step S37). On the other hand, if it is determined that the gradient ΔVms of the magenta toner density vs. output voltage characteristic falls within the predetermined range, the CPU completes the magenta output correction process (step S36).

In FIG. 20, there is shown the output correction process for the toner density detection sensor 147 with respect to the magenta developing device 114M. The output correction processes for the sensor 147 with respect to the cyan, black, and yellow developing devices can be carried out by procedures similar to those shown in FIG. 20.

As described above, according to this embodiment, it is possible to correct a variation in detection sensitivity between toner density detection sensors 147 each for detecting the toner densities of developers in the developing devices, whereby the toner densities of developers in the developing devices can substantially accurately be determined. As a result, a criterion used in determining whether or not toner is properly supplied to the developing devices can be set individually for respective image forming apparatuses, and the toner densities of developers in the developing devices can be stabilized. In addition, it is possible to eliminate a problem in the prior art such that time and effort are required for replacement of the toner density detection sensor and the developing devices and offset adjustment.

Third Embodiment

A third embodiment of this invention differs from the second embodiment in the following points. In other respects, this embodiment is the same as corresponding parts of the second embodiment (FIG. 12) and therefore a description thereof is omitted.

Figure 21:
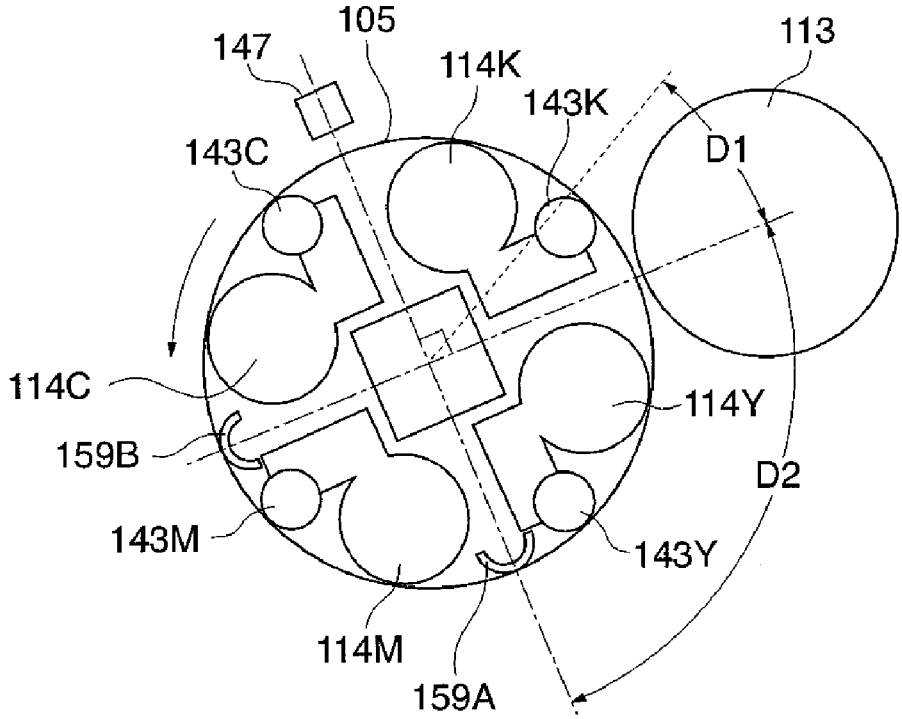
FIG. 21 is a view showing affixed positions of reflection sheets in a developing rotary of an image forming apparatus according to a third embodiment of this invention.

FIG. 21 shows affixed positions of reflection sheets in a developing rotary 105 of an image forming apparatus of this embodiment.

Referring to FIG. 21, two reflection sheets 159A and 159B are affixed to the outer periphery of the developing rotary 105 at positions which are 90 degrees different in phase to each other. The reflection sheet 159A (reference member) is disposed between the yellow developing device 114Y and the magenta developing device 114M. The reflection sheet 159B (reference member) is disposed between the magenta developing device 114M and the cyan developing device 114C. The reflection sheets 159A, 159B are disposed at positions which are 90 degrees different in phase from each other, however, the phase difference therebetween is not limited to 90 degrees.

The reflection sheets 159A, 159B have different predetermined reflectances each of which coincides with the reflectance of a corresponding developer that has a predetermined toner density. As for the magenta developer, the reflectance of the reflection sheet 159A is set to be coincident with the reflectance of a developer having a toner density of Cmx, and the reflectance of the reflection sheet 159B is set to be coincident with the reflectance of a magenta developer having a toner density of Cmy. Depending on developer, the toner densities providing reflectances coincident with the reflectances of the reflection sheets 159A and 159B are different between colors, and therefore, the corresponding developer toner densities are set individually for respective colors.

Next, an operation of correcting the output of the toner density detection sensor 147 will be described. The output correcting operation is carried out upon assembly of the product (image forming apparatus) or upon replacement of the toner density detection sensor. It is not inevitably necessary to replace the developing devices.

Figure 22:
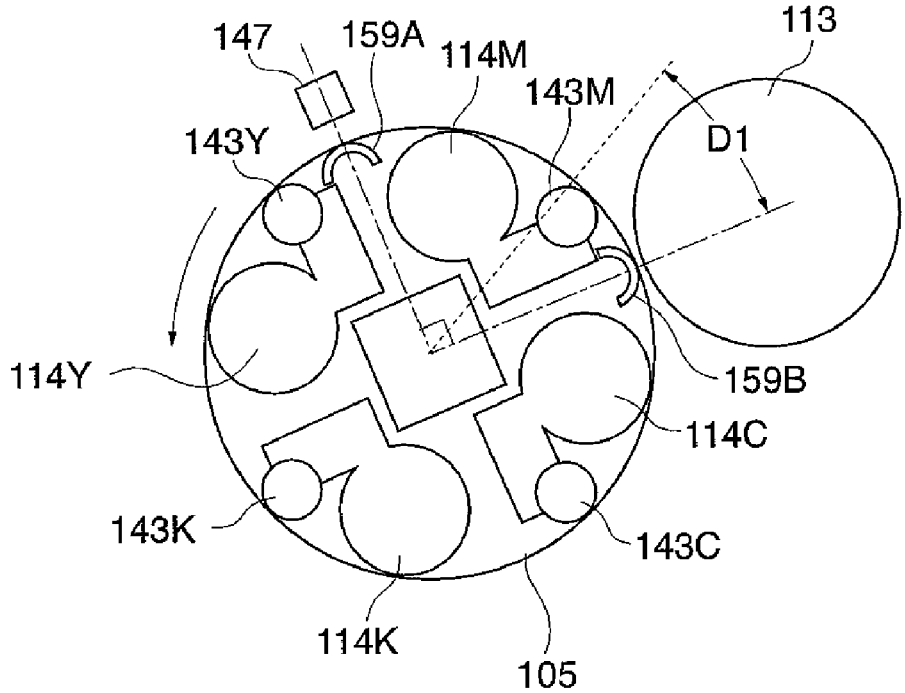
FIG. 22 is a view showing a state that one of reflection sheets is disposed to face the toner density detection sensor at the time of output correction for the sensor.
Figure 23:
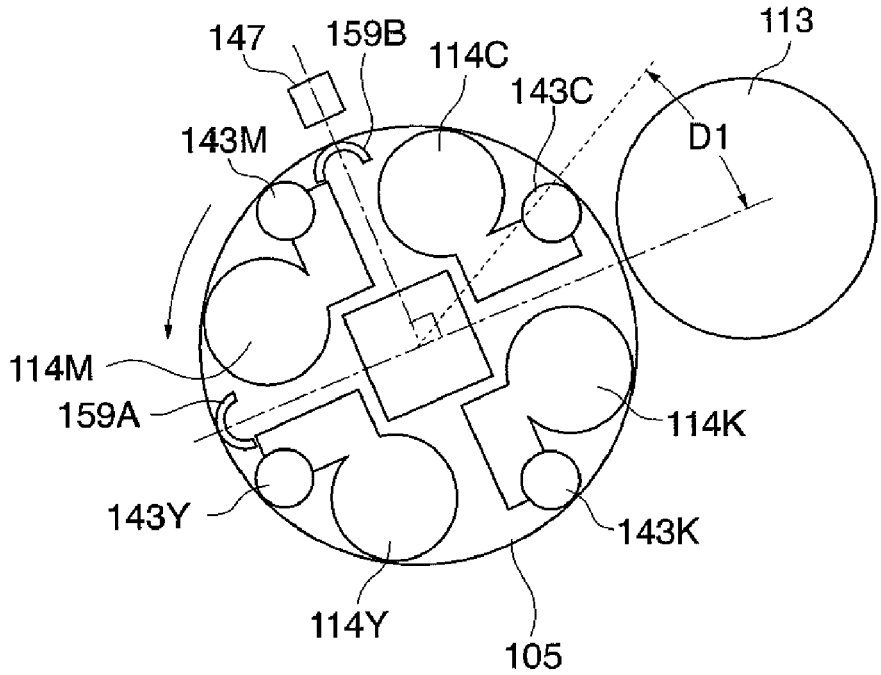
FIG. 23 is a view showing a state where another reflection sheet is disposed to face the toner density detection sensor at the time of output correction for the sensor.

FIG. 22 shows a state where the reflection sheet 159A is disposed to face the toner density detection sensor 147 at the time of output correction for the sensor 147, and FIG. 23 shows a state where the reflection sheet 159B is disposed to face the sensor 147 at the time of output correction for the sensor 147.

As shown in FIG. 22, the CPU of the toner density detection sensor control circuit rotatably drives the developing rotary 105 by a predetermined angle (90+D2 degrees) from the home position (not shown) in the direction of arrow so as to cause the reflection sheet 159A to face the toner density detection sensor 147. Next, the CPU lightens the emission LED of the sensor 147, causes the reflection light receiving element of the sensor 147 to receive reflection light from the reflection sheet 159A, and holds an output voltage Vx of the reflection light receiving element in the memory.

Next, as shown in FIG. 23, the CPU rotatably drives the developing rotary 105 by 90 degrees in the direction of arrow, and causes the reflection sheet 159B to face the toner density detection sensor 147. Subsequently, as in the case of causing the reflection sheet 159A to face the sensor 147, the CPU performs the following processing. Specifically, the CPU lightens the emission LED of the toner sensor 147, causes the reflection light receiving element of the sensor 147 to receive reflection light from the reflection sheet 159B, and holds an output voltage Vy of the reflection light receiving element in the memory.

Figure 24:
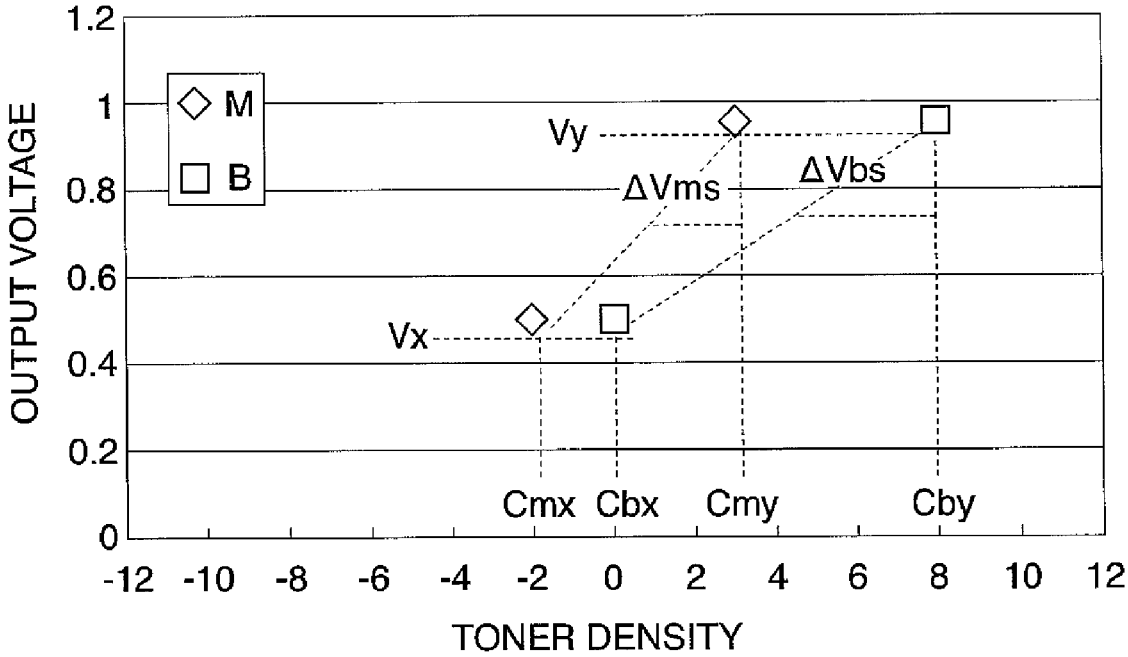
FIG. 24 is a view showing a relation between output voltage of the toner density detection sensor and toner density.

FIG. 24 shows a relation between output voltage of the toner density detection sensor 147 and toner density.

Referring to FIG. 24, there is shown a magenta toner density vs. output voltage characteristic indicated by diamond-shaped marks, as a representative of yellow, magenta, and cyan toner density vs. output voltage characteristics. Also, there is shown a black toner density vs. output voltage characteristic indicated by rectangle-shaped marks. The gradient of the toner density vs. output voltage is different between magenta and black. The magenta characteristic gradient ΔVms can be represented by $\Delta Vms=(Vy-Vx)/(Cmy-Cmx)$. On the other hand, the black characteristic gradient ΔVbs can be represented by $\Delta Vbs=(Vy-Vx)/(Cby-Cbx)$. Similarly, with respect to yellow and cyan, the gradient of the toner density vs. output voltage characteristic can be calculated.

In consideration of a case where a normal value cannot be detected due to a failure in the toner density detection sensor 147 or in the drive system of the developing rotary 105, when the gradient of the toner density vs. output voltage characteristic falls outside a predetermined range, an occurrence of an error is determined and the operation of the main unit of the image forming apparatus is stopped.

Next, a description will be given of a process for correcting the output of the toner density detection sensor 147 according to this embodiment.

Figure 25:
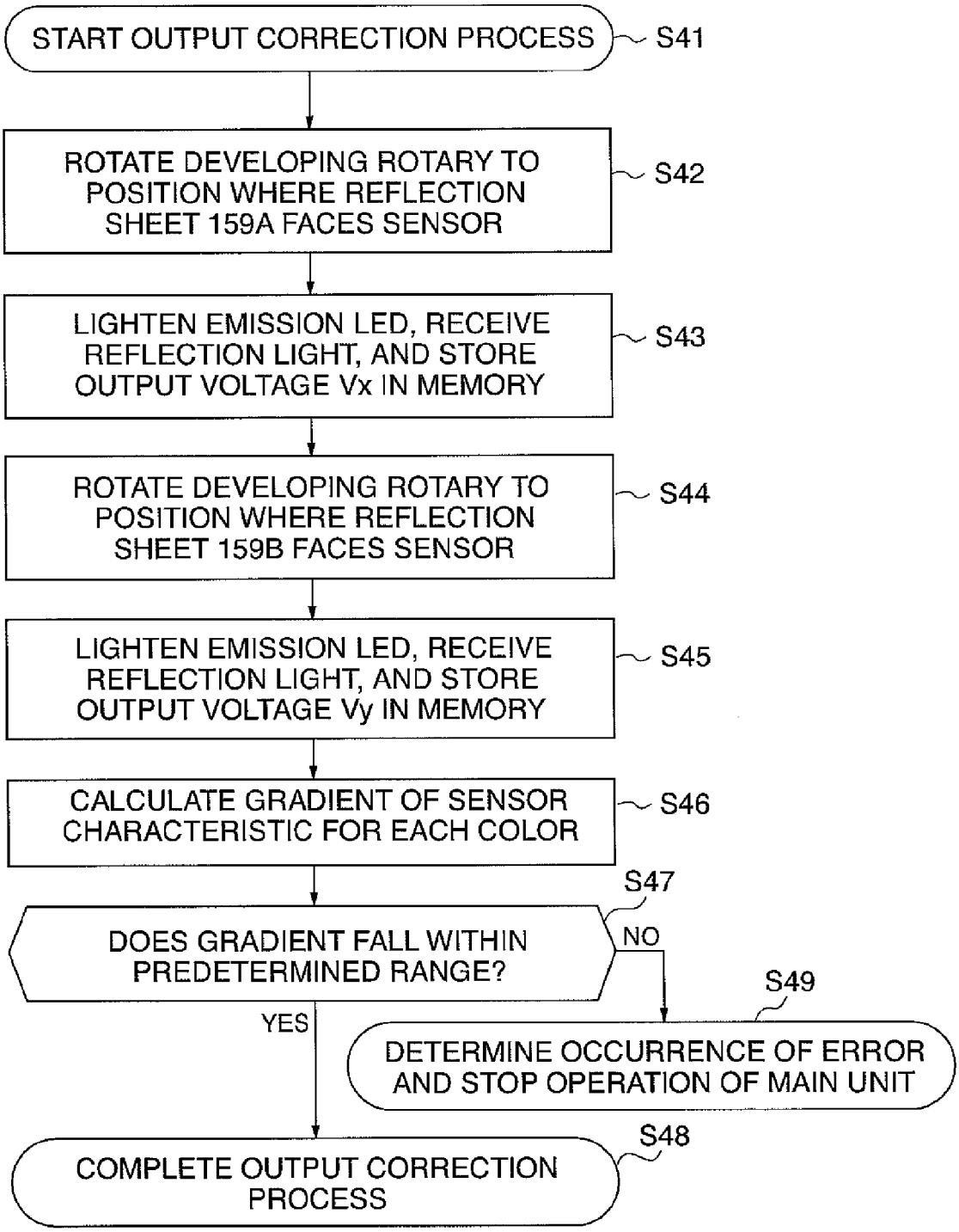
FIG. 25 is a flowchart showing an output correction process for the toner density detection sensor.

FIG. 25 shows in flowchart the output correction process for the toner density detection sensor 147.

Referring to FIG. 25, the CPU of the toner density detection sensor control circuit starts the output correction process for the sensor 147 (step S41). First, the CPU rotatably drives the developing rotary 105 such that the reflection sheet 159A is moved to a position where it faces the sensor 147, and stops the developing rotary 105 there (step S42). Next, the CPU lightens the emission LED of the sensor 147, causes the reflection light receiving element of the sensor 147 to receive reflection light from the reflection sheet 159A, and stores (holds) an output voltage Vx of the sensor 147 in the memory (step S43).

Next, the CPU rotatably drives the developing rotary 105 such that the reflection sheet 159B is moved to a position where it faces the sensor 147, and stops the developing rotary 105 there (step S44). Next, the CPU lightens the emission LED of the sensor 147, causes the reflection light receiving element of the sensor 147 to receive reflection light from the reflection sheet 159B, and holds an output voltage Vy of the sensor 147 in the memory (step S45).

Based on the output voltage Vx obtained in step S43 and the output voltage Vy obtained in step S45, the CPU calculates the gradient of the toner density vs. output voltage characteristic for each color (step S46). Next, the CPU determines whether the gradient of the toner density vs. output voltage characteristic of each color falls within or outside the predetermined range (step S47). If it is determined that the gradient of the toner density vs. output voltage characteristic of any one of the colors falls outside the predetermined range, the CPU determines an occurrence of an error and stops the operation of the main unit of the image forming apparatus (step S49). On the other hand, if it is determined that the gradient of the toner density vs. output voltage characteristic of each color falls within the predetermined range, the CPU completes the present process (step S48).

The value of the gradient ΔVms (in the case of magenta) of the toner density vs. output voltage characteristic obtained by the output correction process for the toner density detection sensor 147 is used when the toner density is calculated based on the output voltage of the sensor 147 during the ordinary operation of the image forming apparatus. The value of the gradient ΔVms is also used for calculating a limit level in accordance with which an error output is generated in the image forming apparatus in a case that toner is not supplied to the developing devices due to an abnormal toner supply operation or a faulty operation of the toner supply system.

A threshold value of the output voltage of the toner density detection sensor 147 used to determine an occurrence of an error for example when the toner density in the developing devices is equal to a value of C1(>C0) is represented by the sum of the output voltage Vm0 at the toner density reference value (at the toner density of C0) and a value of Vs/(C1−C0).

As described above, this embodiment makes it possible to correct a variation in detection sensitivity between toner density detection sensors 147 each for detecting the toner densities of developers in the developing devices, whereby the toner densities of developers in the developing devices can substantially accurately be determined. As a result, the criterion used in determining whether or not toner is properly supplied to the developing devices can be set individually for respective image forming apparatuses, and the toner densities of developers in the developing devices can be stabilized. In addition, a problem in the prior art such that time and effort are required for replacement of the toner density detection sensors and the developing devices and the offset adjustment can be eliminated.

It is to be understood that the present invention may also be accomplished by supplying a system or an apparatus with a storage medium in which a program code of software, which realizes the functions of the above described embodiments is stored, and causing a computer (or CPU or MPU) of the system or apparatus to read out and execute the program code stored in the storage medium.

In this case, the program code itself read from the storage medium realizes the functions of the above described embodiments, and therefore the program code and the storage medium in which the program code is stored constitute the present invention.

Examples of the storage medium for supplying the program code include a flexible disk, a hard disk, a magnetic-optical disk, a CD-ROM, a CD-R, a CD-RW, a DVD-ROM, a DVD-RAM, a DVD-RW, a DVD+RW, a magnetic tape, a nonvolatile memory card, and a ROM.

Further, it is to be understood that the functions of the above described embodiments may be accomplished not only by executing the program code read out by a computer, but also by causing an OS (operating system) or the like which operates on the computer to perform a part or all of the actual operations based on instructions of the program code.

Further, it is to be understood that the functions of the above described embodiments may be accomplished by writing a program code read out from the storage medium into a memory provided on an expansion board inserted into a computer or a memory provided in an expansion unit connected to the computer and then causing a CPU or the like provided in the expansion board or the expansion unit to perform a part or all of the actual operations based on instructions of the program code.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-304605, filed Nov. 26, 2007, which is hereby incorporated by reference herein in its entirety.

What is claimed is:

1. An image forming apparatus comprising:

an image carrier adapted to be formed with an electrostatic latent image;

a developing unit adapted to develop the electrostatic latent image formed on said image carrier using a developer including toner;

a detection unit which has a light emitting unit adapted to irradiate light onto the developer in said developing unit and a light receiving unit adapted to receive light reflected by said developer, said detection unit being adapted to output a signal corresponding to a toner density representing a toner ratio in the developer; and a determination unit adapted to determine whether or not a difference between a signal output from said detection unit when said detection unit detects a developer having a predetermined density and a signal output from said detection unit when said detection unit detects a reference member having a density different from the predetermined density falls within a predetermined range;

wherein said detection unit is disposed so as to face a toner bearing member in said developing unit and adapted to detect the density of toner on said toner bearing member, the reference member is disposed on a surface of a shutter member which is irradiated by said light emitting unit, said shutter member is disposed between said toner bearing member and said detection unit to protect a light receiving surface of said light receiving unit, and said shutter member is openable and closeable.

2. An image forming apparatus comprising:

an image carrier adapted to be formed with an electrostatic latent image;

a developing unit adapted to develop the electrostatic latent image formed on said image carrier using a developer including toner;

a detection unit which has a light emitting unit adapted to irradiate light onto the developer in said developing unit and a light receiving unit adapted to receive light reflected by said developer, said detection unit being adapted to output a signal corresponding to a toner density representing a toner ratio in the developer; and a determination unit adapted to determine whether or not a difference between a signal output from said detection unit when said detection unit detects a developer having a predetermined density and a signal output from said detection unit when said detection unit detects a reference member having a density different from the predetermined density falls within a predetermined range;

wherein said detection unit is disposed so as to face a toner bearing member in said developing unit and adapted to detect the density of toner on said toner bearing member, the reference member is disposed on a surface of a shutter member which is irradiated by said light emitting unit, said shutter member is disposed between said toner bearing member and said detection unit to protect a light receiving surface of said light receiving unit, and said shutter member is openable and closeable; and wherein said determination unit performs the determination based on an amount of reflection light from the reference member obtained when the shutter member is in a closed state and an amount of reflection light from the developer in said developing unit obtained when the shutter member is in an open state.

* * * * *